US012089680B2

(12) United States Patent
Yuan et al.

(10) Patent No.: US 12,089,680 B2
(45) Date of Patent: Sep. 17, 2024

(54) BODY-SIZE-ADJUSTABLE DRESSMAKER FORM

(71) Applicant: Zhuyong Yuan, Qingdao (CN)

(72) Inventors: Zhuyong Yuan, Qingdao (CN); Haolin Yuan, Qingdao (CN)

(73) Assignee: Zhuyong Yuan, Qingdao (CN)

( * ) Notice: Subject to any disclaimer, the term of this patent is extended or adjusted under 35 U.S.C. 154(b) by 0 days.

(21) Appl. No.: 18/452,548

(22) Filed: Aug. 20, 2023

(65) Prior Publication Data

US 2023/0404196 A1 Dec. 21, 2023

Related U.S. Application Data

(63) Continuation of application No. PCT/CN2023/097296, filed on May 31, 2023.

(30) Foreign Application Priority Data

Jun. 14, 2022 (CN) ..... 202210668811.3

(51) Int. Cl.
*A41H 5/01* (2006.01)

(52) U.S. Cl.
CPC ..... *A41H 5/01* (2013.01)

(58) Field of Classification Search
CPC ..... A41H 5/01; A41H 5/00; A47F 8/00
See application file for complete search history.

(56) References Cited

U.S. PATENT DOCUMENTS

| | | | | | |
|---|---|---|---|---|---|
| 991,455 | A * | 5/1911 | Rae | A41H 5/01 | 223/68 |
| 1,773,955 | A * | 8/1930 | Couture | A41H 5/01 | 223/68 |
| 3,734,362 | A * | 5/1973 | Arthur | A41H 5/01 | 223/68 |
| 4,493,445 | A * | 1/1985 | Arthur | A41H 5/01 | 223/68 |
| 5,265,779 | A * | 11/1993 | Jiang | A41H 5/01 | 223/66 |
| 9,010,758 | B1 | 4/2015 | Malmloff | | |
| 9,498,011 | B2 | 11/2016 | Chan et al. | | |
| 10,349,704 | B2 | 7/2019 | Sharp | | |

* cited by examiner

*Primary Examiner* — Nathan E Durham
(74) *Attorney, Agent, or Firm* — True Shepherd LLC; Andrew C. Cheng

(57) ABSTRACT

A body-size-adjustable dressmaker form includes a central-support adjusting system, a neck adjusting system, a chest adjusting system, a waist adjusting system, a hip adjusting system, an arm adjusting system, a base and an upper-body outer housing. The chest adjusting system, the waist adjusting system and the hip adjusting system each include a multi-axis synchronous co-directional adjusting device and an adjusting knob. The central-support adjusting system includes an upper-body support assembly provided with mounting positions adapted to the multi-axis synchronous co-directional adjusting devices. Each multi-axis synchronous co-directional adjusting device includes a telescopic structural member connected with the adjusting knob. Multiple housing units are sequentially connected to form the upper-body outer housing, and the multiple housing units are connected with the telescopic structural members respectively. When the adjusting knob is rotated, the telescopic structural members drive the housing units to move close to or away from each other.

10 Claims, 13 Drawing Sheets

BODY-SIZE-ADJUSTABLE DRESSMAKER FORM

CROSS-REFERENCE TO RELATED APPLICATIONS

This application is a continuation of International Patent Application No. PCT/CN2023/097296 with a filing date of May 31, 2023, designating the United States, and further claims the priority to Chinese Patent Application No. 202210668811.3, with a filing date of Jun. 14, 2022. The content of the aforementioned applications, including any intervening amendments thereto, are incorporated herein by reference in its entirety.

FIELD

The present application relates to the technical field of an auxiliary device for manufacturing garments, and in particular to a body-size-adjustable dressmaker form.

BACKGROUND

Because of different figures, people with same height and weight wear standard garments to have two different effects: fit and unfit. If a wearer has a high requirement on the fitness of a customized garment, the garment shall be made according to the wearer's particular figure. The human body is in a three-dimensional form, which has not only girth characteristics, but also angular characteristics. The conventional plane pattern making only has girth characteristics. Even certain three-dimensional shapes may be formed through darts, the conventional plane pattern making still cannot fully conform to the angular characteristics of human body. The conventional three-dimensional pattern making is to make a pattern based on a standard dressmaker form, but it does not involve the angular characteristics of human body either. The garment made by this method does not fit well and generally needs to be tried on and altered several times to get close to the design effect.

Existing body measurement techniques are classified into two categories: manual method and imaging method. The imaging method is to collect human body contour data by using photoelectric means, and then process the data with software to form a three-dimensional image. The manual method is to directly obtain data of superficial characteristics of human body with measuring tools or machinery. Both of these methods allow the acquisition of the girth and angular characteristic values of human body. When using these three-dimensional data to make the pattern, it is necessary to use a dressmaker form with adjustable size and angle for the waist, hip, and other parts of the human body.

At present, some of the dressmaker forms in the market need size adjustment at different positions when they are in use. The size adjustment is very complicated to operate, and there is no auxiliary mark for body length adjustment, and it is impossible to measure and design a complete garment by arm adjustment of these dressmaker forms.

Therefore, it is urgent to provide a new technical solution to solve the problems existing in the conventional technology.

SUMMARY

A body-size-adjustable dressmaker form is provided according to the present application for solving the problem of complicated adjustment operation in the use of the dressmaker form in the conventional technology.

In order to achieve the above objects, the following technical solutions are provided according to the present application.

In an aspect, a body-size-adjustable dressmaker form is provided according to the present application, which includes a central-support adjusting system, a neck adjusting system, a chest adjusting system, a waist adjusting system, a hip adjusting system, an arm adjusting system, a base and an upper-body outer housing, where:

- the chest adjusting system, the waist adjusting system and the hip adjusting system each include a multi-axis synchronous co-directional adjusting device and an adjusting knob;
- the central-support adjusting system includes an upper-body support assembly and a lower-body support assembly, where the upper-body support assembly is provided with mounting positions adapted to the multi-axis synchronous co-directional adjusting devices;
- each of the multi-axis synchronous co-directional adjusting devices includes a fixed frame and multiple adjusting components each mounted on the fixed frame, where each of the multiple adjusting components includes a bevel gear, a telescopic structural member and a transmission rod connecting the bevel gear with the telescopic structural member; the multiple bevel gears are arranged to circle an outer wall of the upper-body support assembly in the fixed frame, and any two adjacent bevel gears are engaged with each other for transmission;
- the telescopic structural member includes a first adjusting rod, a second adjusting rod and an adjusting shaft connected with the transmission rod, where the first adjusting rod and the second adjusting rod are arranged to oppose each other and be spaced apart in an up-down direction, and the adjusting shaft is arranged between the first adjusting rod and the second adjusting rod and is engaged with the first adjusting rod and the second adjusting rod respectively for transmission;
- the upper-body outer housing is formed by multiple housing units connected end to end in sequence, and one of any two adjacent housing units is connected with the first adjusting rod and the other is connected with the second adjusting rod;
- the adjusting knob is connected with one of the adjusting shafts, where when the adjusting knob is rotated in a first rotation direction, the corresponding adjusting shaft is driven to rotate forward, driving the first adjusting rod to move in a first horizontal direction and driving the second adjusting rod to move in a second horizontal direction, where the first horizontal direction is opposite to the second horizontal direction, so that a distance between the two housing units connected with the first adjusting rod and the second adjusting rod respectively is gradually increased; and when the adjusting knob is rotated in a second rotation direction, the adjusting shaft is driven to rotate reversely, driving the first adjusting rod to move in the second horizontal direction and driving the second adjusting rod to move in the first horizontal direction, so that the distance between two housing units connected with the first adjusting rod and the second adjusting rod respectively is gradually reduced.

Further to the above technical solution, each multi-axis synchronous co-directional adjusting device includes four adjusting components. The telescopic structural member further includes a scale, and the first adjusting rod and the second adjusting rod are each provided with a sliding groove adapted to an end of the scale. When the first adjusting rod and the second adjusting rod are driven to move, the scale is configured for measuring the distance between two housing units connected with the first adjusting rod and the second adjusting rod respectively.

In one embodiment, the upper-body support assembly includes a first pipe body and a second pipe body, where the second pipe body, with one end inserted into the first pipe body, reciprocatingly telescopes along a central axis of the first pipe body.

In one embodiment, a first annular recess is formed on the first pipe body, and the first annular recess is a clamping recess depressed from a side wall of the first pipe body to a center of the pipe body. Multiple bevel gears of the multi-axis synchronous co-directional adjusting device of the chest adjusting system are arranged to circle an outer wall of the first annular recess.

In one embodiment, the first pipe body, along its radial direction, is inserted with a spring fixing pin arranged below the first annular recess.

In one embodiment, one end of the second pipe body is adapted to an inner diameter of the first pipe body, and the other end of the second pipe body forms a lock flange. A second annular recess and a third annular recess, with the same structure as the first annular recess, are spaced apart on the second pipe body, where multiple bevel gears of the multi-axis synchronous co-directional adjustment device of the waist adjusting system are arranged to circle an outer wall of the second annular recess, and multiple bevel gears of the multi-axis synchronous co-directional adjusting device of the hip adjusting system are arranged to circle an outer wall of the third annular recess.

In one embodiment, a fixing component is sleeved outside an outer wall of the first pipe body at which the first pipe body is connected with the second pipe body. The fixing component includes a fixing ring and a fixing disk arranged at one end of the fixing ring, where multiple fixing iron sheets are evenly distributed along an edge of the fixing disk. One end of each fixing iron sheet is connected with the fixing disk, and the other end thereof extends toward the base and is fixedly connected with the bottom of the upper-body outer housing. The fixing iron sheet is S-shaped.

In one embodiment, the fixing ring is sleeved outside the outer wall of the first pipe body, and the inner diameter of the fixing ring is greater than the outer diameter of the first pipe body. The outer wall of the fixing ring is provided with a fastening screw, one end of the fastening screw is directed through the outer wall of the fixing ring to abut against the outer wall of the first pipe body, and the fastening screw is threaded to the fixing ring.

In one embodiment, the side wall of the fixing ring is provided with a spring mounting seat corresponding to the spring fixing pin, and the spring mounting seat and the spring fixing pin form mounting positions for two ends of a telescopic spring respectively. The number of the telescopic spring may be more than one.

In one embodiment, a pipe section, inserted into the first pipe body, of the second pipe body is provided with a first positioning pin which is arranged in the second pipe body along the radial direction of the second pipe body.

In one embodiment, the second pipe body is internally provided with an ejecting rod, where one end of the ejecting rod is provided with a cross groove, and the first positioning pin is embedded in the cross groove for positioning the ejecting rod.

In one embodiment, the lower-body support assembly includes a third pipe body and a telescopic adjusting component arranged on the third pipe body. The telescopic adjusting component includes a cylindrical housing, a push-pull rod, an adjusting screw and a fixing clip.

In one embodiment, the cylindrical housing is a cylinder with an opening at one end. The push-pull rod is inserted into the cylindrical housing from the opening, and the other end of the cylindrical housing is provided with a connecting screw.

In one embodiment, a side wall of the push-pull rod is formed with a slot in which a transmission rack is arranged. The transmission rack extends along a central axis direction of the push-pull rod, and a size indicator is arranged on the side wall, close to the base, of the push-pull rod.

In one embodiment, two through holes are oppositely arranged on the side wall of the cylindrical housing, and the adjusting screw is directed through the two through holes in turn. The adjusting screw, through its teeth adapted to the transmission rack, is engaged with the push-pull rod for transmission, and the push-pull rod is driven by the adjusting screw to extend up and down along the central axis of the cylindrical housing.

In one embodiment, one end of the adjusting screw is provided with a clamping member, and an outer diameter of the clamping member is greater than the width of a guide groove, so as to limit the adjusting screw. The other end of the adjusting screw is provided with a nut, and a limit spring is arranged between the nut and the side wall of the cylindrical housing to abut against the nut and the side wall of the cylindrical housing respectively.

In one embodiment, the fixing clip, close to the opening, is arranged on the side wall of the cylindrical housing, and an end of the push-pull rod protruding from the opening is connected with an end of the ejecting rod. The end of the cylindrical housing with the opening is connected with the lock flange. The fixing clip is configured to lock and release the lock flange.

In one embodiment, the neck adjusting system includes a collar telescopic adjusting component, an embedded cover component, an adjusting handle and a connecting elbow.

In one embodiment, the collar telescopic adjusting component includes a built-in fixing member and an even number of telescopic members mounted on the built-in fixing member. The even number of telescopic members are connected in sequence to form an annular collar structure, and each of the telescopic members includes an arc-shaped housing and a rack shaft arranged on a concave surface of the arc-shaped housing. When the even number of telescopic members are connected into the annular structure, the even number of rack shafts are inserted into reserved channels of the built-in fixing member respectively, so that the even number of rack shafts are staggered to form an annular channel. A center point of the annular channel coincides with a center point of the annular structure, and the annular channel forms a mounting position for the adjusting handle.

In one embodiment, the embedded cover component includes a disk embedded in the annular structure defined by the even number of telescopic members, and an outer diameter of the disk is smaller than an inner diameter of the annular structure. A through hole is defined at the center of the disk, and a surface, facing away from the telescopic member, of the disk is provided with size scale marks and multiple grooves, where the size scale marks are arranged along the through hole, and pin foam is arranged in the multiple grooves.

In one embodiment, the adjusting handle is a T-shaped member. The adjusting handle includes a transmission shaft and a driving knob arranged at one end of the transmission shaft, and an insertion hole is defined at the other end of the transmission shaft. The side wall, between the driving knob and the insertion hole, of the transmission shaft is formed with teeth adapted to the rack shaft, and a stop spring is sleeved outside the outer wall of the transmission shaft.

In one embodiment, the transmission shaft sleeved with the stop spring is directed through the through hole on the disk and the annular channel on the collar telescopic adjusting component in sequence. The insertion hole on the transmission shaft is located outside the annular channel, and a pin is mounted in the insertion hole, so that the adjusting handle is detachably connected to the collar telescopic adjusting component.

In one embodiment, an upper surface of the driving knob is higher than an upper surface of the disk. When the adjusting handle is pressed down and the driving knob is rotated, the teeth on the adjusting handle drive the rack shafts of the telescopic members to move back and forth along the reserved channels of the built-in fixing member, realizing the telescopic adjustment for the even number of telescopic members. Thus, the circumference of the annular structure defined by the arc-shaped housing of the even number of telescopic members can be expanded or reduced.

In one embodiment, the connecting elbow includes an elbow-pipe structural member. One end of the connecting elbow forms an inclined mounting seat, where an inclination angle of the inclined mounting seat is the same as that of the neck relative to the spine of a human body, the inclined mounting seat is connected with the bottom of the built-in fixing member, and the other end of the connecting elbow is connected with the central-support adjusting system.

In one embodiment, a side wall of the connecting elbow is provided with a locking hole in which a fastening pin adapted thereto is inserted.

In one embodiment, the arm adjusting system includes an arm outer housing and an arm size-adjusting mechanism.

In one embodiment, the arm outer housing is formed by a first housing and a second housing, where the first housing includes a first upper arm housing and a first forearm housing, and the second housing includes a second upper arm housing and a second forearm housing. The first housing and the second housing are joined in a front-rear or left-right direction, and magnets are arranged at one end of the first housing and one end of the second housing respectively, allowing the first housing and the second housing to be attached to shoulder parts of the upper-body outer housing through the magnets.

In one embodiment, the arm size-adjusting mechanism includes an arm-circumference adjusting component and an arm-length adjusting component.

In one embodiment, one arm-circumference adjusting component is arranged at a joint of the first upper arm housing and the second upper arm housing, and the arm-circumference adjusting component is connected with both the first upper arm housing and the second upper arm housing. Another arm-circumference adjusting component is arranged at a joint of the first forearm housing and the second forearm housing, and the arm-circumference adjusting component is connected with both the first forearm housing and the second forearm housing.

In one embodiment, the arm-circumference adjusting component includes two housing fixing members arranged opposite to each other, a telescopic adjusting member connected with the two housing fixing members, and a fixed scale arranged on the two housing fixing members. One end of each housing fixing member forms a connecting seat connected with the arm outer housing, and the other end thereof forms a mounting hole adapted to the telescopic adjusting member. The telescopic adjusting member includes a driving wheel, and a left driving rod and a right driving rod arranged on two sides of the driving wheel respectively, where the left driving rod is provided with right-handed teeth and the right driving rod is provided with left-handed teeth, and each of the left driving rod and the right driving rod is adaptively connected with the mounting hole of the corresponding housing fixing member. The mounting hole of one of the two housing fixing members is provided with teeth that engage with the right-handed teeth on the left driving rod, and the mounting hole of the other housing fixing member is provided with teeth that engage with the left-handed teeth on the right driving rod.

In one embodiment, the arm-circumference adjusting component further includes two linkage rods connected with the housing fixing members. An end, facing away from the housing fixing members, of each linkage rod is connected with the arm outer housing, and each linkage rod is provided with a slide groove in which a fixed scale is arranged. The two linkage rods are driven by the housing fixing members to move left and right.

In one embodiment, the arm-length adjusting component includes a telescopic rod arranged inside the arm outer housing along the length direction of the arm outer housing, a fixed mounting component, a guide adjusting member and a rotational knob.

In one embodiment, an outer wall of the telescopic rod is provided with teeth adapted to the driving wheel. One end of the telescopic rod is located in the upper arm part of the arm outer housing, and a through hole, with a pin shaft inserted therein, is arranged on the side wall near this end. The other end of the telescopic rod is located in the forearm part of the arm outer housing, and this end is provided with the rotational knob.

In one embodiment, the fixed mounting component includes a mounting cap sleeved outside the telescopic rod and engaged with the telescopic rod for transmission. The outer wall of the mounting cap is provided with a connector connected with the inner wall of the arm outer housing. The connector includes a connecting rod and a fixing cap which is slidably connected with the connecting rod and fixed on the arm outer housing.

In one embodiment, the guide adjusting member is mounted on the side wall of the telescopic rod near the rotational knob, and includes a guide plate sleeved outside the outer wall of the telescopic rod. The center of the guide plate is provided with a connecting hole which is engaged with the telescopic rod, and four guide grooves are formed on the guide plate. Each of the four guide grooves is such groove extending from an outer edge of the guide plate toward the outer wall of the connecting hole. The four guide grooves are provided with four slide members respectively each of which is connected with the first forearm housing or the second forearm housing.

In one embodiment, when the telescopic rod is driven to rotate by turning the rotational knob, the telescopic rod drives the driving wheel engaged therewith to rotate, so that the two housing fixing members engaged with the left driving rod and the right driving rod respectively get close to each other or away from each other. When the two housing fixing members approach each other, outer diameters of the upper arm housing and the forearm housing formed by the first housing and second housing are reduced at the same time. When the two housing fixing members move away from each other, the outer diameters of the upper arm housing and the forearm housing formed by the first housing and second housing are increased at the same time. When the outer diameters of the upper arm housing and the forearm housing formed by the first housing and the second housing are simultaneously reduced or increased, the slide members are driven to slide in the guide grooves.

In one embodiment, two fixed mounting components are provided, where one of the two fixed mounting components is mounted on the upper arm part of the arm outer housing, and the other is mounted on the forearm part of the arm outer housing. When the telescopic rod is driven to rotate by turning the knob, the mounting cap of each of the two fixed mounting components slides up and down relative to the telescopic rod, so that the housing of the upper arm part connected with one of the two fixed mounting components moves close to or away from the housing of the forearm part connected with the other fixed mounting component, thus realizing the adjustment of arm length.

In one embodiment, the base includes a fourth pipe body and a bottom support arranged at one end of the fourth pipe body.

In one embodiment, the fourth pipe body is connected with the third pipe body, and a support frame is mounted on a side wall of the fourth pipe body. One end of the support frame is rotatably connected with the fourth pipe body, and the other end of the support frame is provided with a V-shaped clip.

In one embodiment, the bottom support includes a support seat and rollers arranged at the bottom of the support seat.

Compared with the conventional technology, the present application has the following beneficial effects.

1. The body-size-adjustable dressmaker form is provided according to the present application, which includes a central-support adjusting system, a neck adjusting system, a chest adjusting system, a waist adjusting system, a hip adjusting system, an arm adjusting system, a base and an upper-body outer housing. The upper-body outer housing mentioned in the present application includes continuous curves fitting the shoulder, chest, waist and hip of a human body. The chest adjusting system, the waist adjusting system and the hip adjusting system provided by the present application are each adjusted by a multi-axis synchronous co-directional adjusting device. In specific applications, the multi-axis synchronous co-directional adjusting device may be a four-axis synchronous co-directional adjusting device which divides the upper-body outer housing into four parts. A distance between two connected parts is adjusted by the four-axis synchronous co-directional adjusting device. In the process of adjustment, it is simple and easy to realize synchronous adjustment by the adjusting knob.

2. The telescopic structural member of the multi-axis synchronous co-directional adjusting device of the body-size-adjustable dressmaker form provided by the present application includes a scale for measuring the distance between two connected housing units in the adjustment process. Based on the size of the dressmaker form, the adjustment distance may be associated with the dimensions such as chest circumference, waist circumference and the like, and the graduation of the scale may be customized, so that the dimensions of chest circumference, waist circumference or hip circumference can be directly read out from the scale during the adjustment.

3. The upper-body support assembly of the body-size-adjustable dressmaker form provided according to the present application includes a first pipe body, a second pipe body inserted in the first pipe body, and a fixing component sleeved outside an outer wall of the first pipe body at which the first pipe body is connected with the second pipe body. A telescopic spring is mounted to the fixing component and the first pipe body, and the second pipe body is provided with an ejecting rod configured to be driven to move up and down to realize telescopic adjustment of the central waist length.

4. The lower-body support assembly of the body-size-adjustable dressmaker form provided according to the present application includes a third pipe body and a telescopic adjusting component arranged on the third pipe body. The telescopic adjusting component can abut against the ejecting rod, and the upward and downward movement of the ejecting rod is realized through the push-pull rod of the telescopic adjusting component, so as to drive the adjustment of the central waist length. Further, the telescopic adjusting component is provided with a size indicator configured to indicate the adjusted length intuitively, and the operator can directly obtain the adjusted central waist length from the size indicator.

5. The neck adjusting system of the body-size-adjustable dressmaker form according to the present application includes a collar telescopic adjusting component, an embedded cover component, an adjusting handle and a connecting elbow. The neck adjusting system is connected with the upper-body support assembly through the connecting elbow. The collar telescopic adjusting component realizes telescopic adjustment of the outer diameter of the collar through the built-in fixing member and the even number of telescopic members mounted on the built-in fixing member. The disk of the embedded cover component is provided with a groove for accommodating pin foam configured for accommodating pins for fixing cloth.

6. The arm adjusting system of the body-size-adjustable dressmaker form provided according to the present application includes an arm outer housing and an arm size-adjusting mechanism. The arm size-adjusting mechanism includes arm-circumference adjusting components and an arm-length adjusting component, where the arm-circumference adjusting components and the arm-length adjusting component can be adjusted at the same time via a rotational knob, the adjustment being simple and convenient. The arm-circumference adjusting component is provided with a fixed scale, and the operator can directly know the arm circumference from the fixed scale.

BRIEF DESCRIPTION OF THE DRAWINGS

In order to illustrate technical solutions in embodiments of the present application more clearly, drawings used in the embodiments are briefly introduced hereinafter. Apparently, the drawings in the following description illustrate only some embodiments of the present application, and other drawings may be obtained by those skilled in the art based on these drawings without any creative efforts. It should be understood that the specific shapes and structures shown in the drawings should not be considered as limitations for realizing the present application in common situations. For example, based on the technical concepts and exemplary drawings disclosed in the present application, those skilled in the art have the ability to easily make routine adjustments or further optimization on the subordination definition/number increasing/number reducing, specific shape, positional relation, connection method, and size proportion relation of some units (components).

Figure 1:
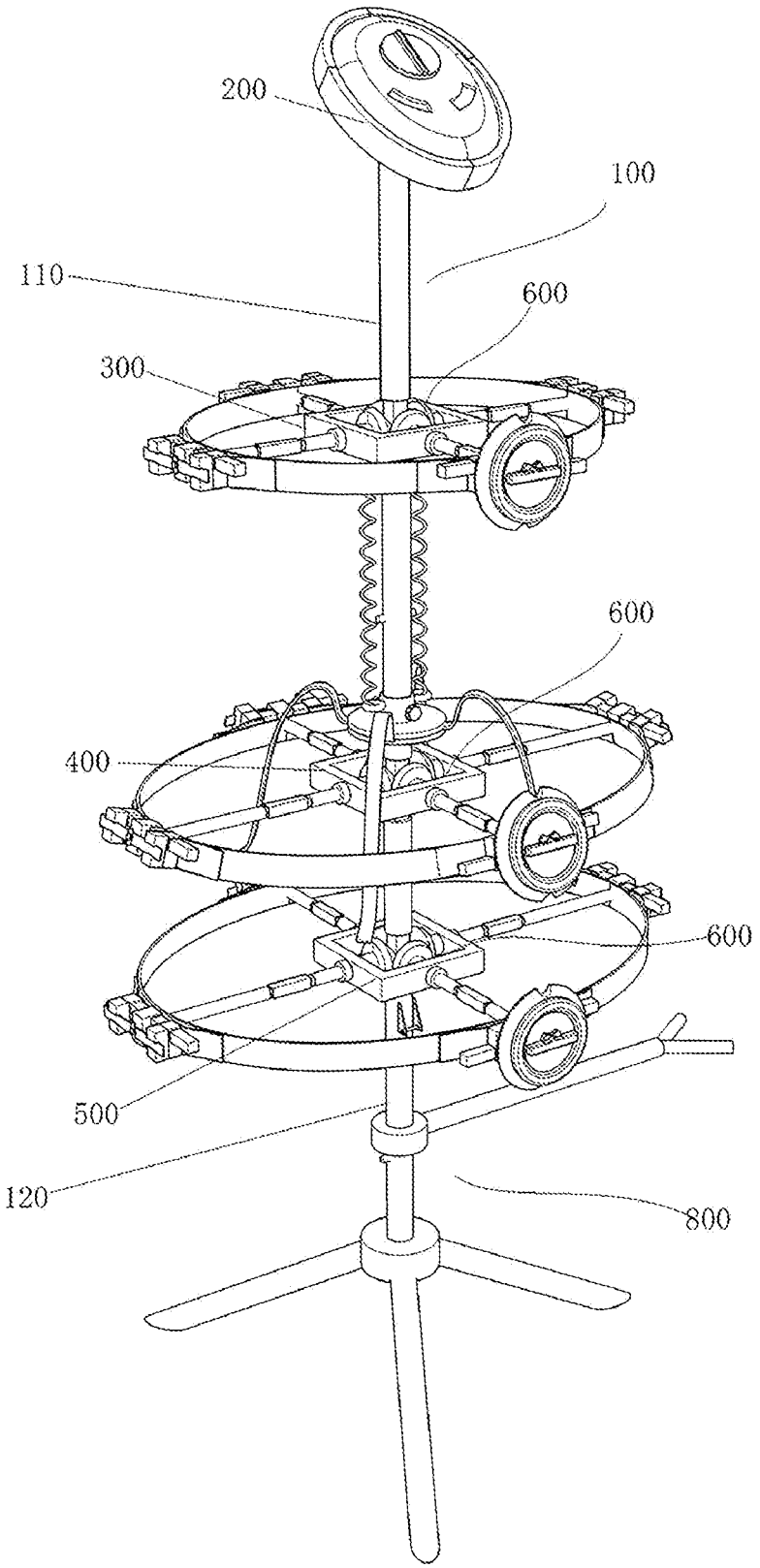
FIG. 1 is a schematic structural view of a dressmaker form according to an embodiment of the present application, taken form a certain perspective.

Reference numerals in the drawings are listed as follows:

100 central-support adjusting system;

110 upper-body support assembly; 111 first pipe body; 1111 first annular recess; 1112 spring fixing pin; 112 second pipe body; 1121 lock flange; 1122 second annular recess; 1123 third annular recess; 1124 first positioning pin; 113 ejecting rod; 114 fixing component; 1141 fixing ring; 1142 fixing disk; 1143 fixing iron sheet; 1144 fastening screw; 1145 spring mounting seat; 115 telescopic spring;

120 lower-body support assembly; 121 third pipe body; 122 telescopic adjusting component; 1221 cylindrical housing; 1222 push-pull rod; 1223 transmission rack; 1224 adjusting screw; 1225 limit spring; 1226 fixing clip;

200 neck adjusting system; 210 collar telescopic adjusting component; 211 built-in fixing member; 212 telescopic member; 2121 arc-shaped housing; 2122 rack shaft; 220 embedded cover component; 221 pin foam; 230 adjusting handle; 231 driving knob; 232 insertion hole; 233 stop spring; 240 connecting elbow;

300 chest adjusting system; 400 waist adjusting system; 500 hip adjusting system; 600 multi-axis synchronous co-directional adjusting device; 610 fixed frame; 620 bevel gear; 630 transmission rod; 640 telescopic structural member; 641 first adjusting rod; 642 second adjusting rod; 643 adjusting shaft; 644 scale; 645 adjusting knob;

700 arm adjusting system;

710 arm-circumference adjusting component; 711 housing fixing member; 7111 connecting seat; 7112 mounting hole; 712 telescopic adjusting member; 7121 drive wheel; 7122 left driving rod; 7123 right driving rod; 7124 fixed scale; 713 linkage rod;

720 arm-length adjusting component; 721 telescopic rod; 722 fixed mounting component; 7221 mounting cap; 723 guide adjusting member; 7231 guide plate; 7232 guide groove; 7233 slide member; 724 rotational knob;

800 bottom seat; 810 fourth pipe body; 820 support frame; 821 bottom support; 822 support seat.

DETAILED DESCRIPTION OF THE EMBODIMENTS

The present application is further described in detail through specific embodiments in conjunction with the accompanying drawings.

In the description of the present application, the expression "multiple" or "a plurality of" indicates two or more unless otherwise specified. The terms "first", "second" and "third" used in the present application are intended to distinguish the objects referred to and do not have special meaning in technical sense (for example, the terms should not be understood as emphasizing on importance or order). Expressions such as "including", "containing" and "having" also mean "not limited to" (some units, parts, materials, steps, etc.).

The terms used in the present application, such as "upper", "lower", "left", "right" and "middle", are generally for the convenience of intuitive understanding with reference to the accompanying drawings, and are not absolute limitations on the positional relation in actual product. Without departing from the technical concept disclosed in the present application, these changes in relative positional relations should also be considered as within the disclosed scope of the present application.

Embodiments

At present, for some dressmaker form products in the market, users need to adjust sizes at different positions. The size adjustment is very complicated to operate, and there is no auxiliary mark for body length adjustment, and it is impossible to measure and design a complete garment by arm adjustment of these dressmaker form products. However, a body-size-adjustable dressmaker form according to the present application is capable of solving the above problem.

The body-size-adjustable dressmaker form according to the present application is a tool, mainly for the field of garment design, which is configured to measure correctly in the use process under different three measurements and body lengths. The body-size-adjustable dressmaker form according to the present application synchronously adjusts different body three-dimensional sizes and different body length sizes mainly through a segmented four-axis synchronous co-directional adjusting system in the dressmaker form.

A body-size-adjustable dressmaker form is provided according to the present application, which includes a central-support adjusting system 100, a neck adjusting system 200, a chest adjusting system 300, a waist adjusting system 400, a hip adjusting system 500, an arm adjusting system 700, a base 800 and an upper-body outer housing. The upper-body outer housing mentioned in the present application includes continuous curves fitting the shoulder, chest, waist and hip of a human body.

The structures of the chest adjusting system 300, the waist adjusting system 400 and the hip adjusting system 500 is described in detail below.

Figure 13:
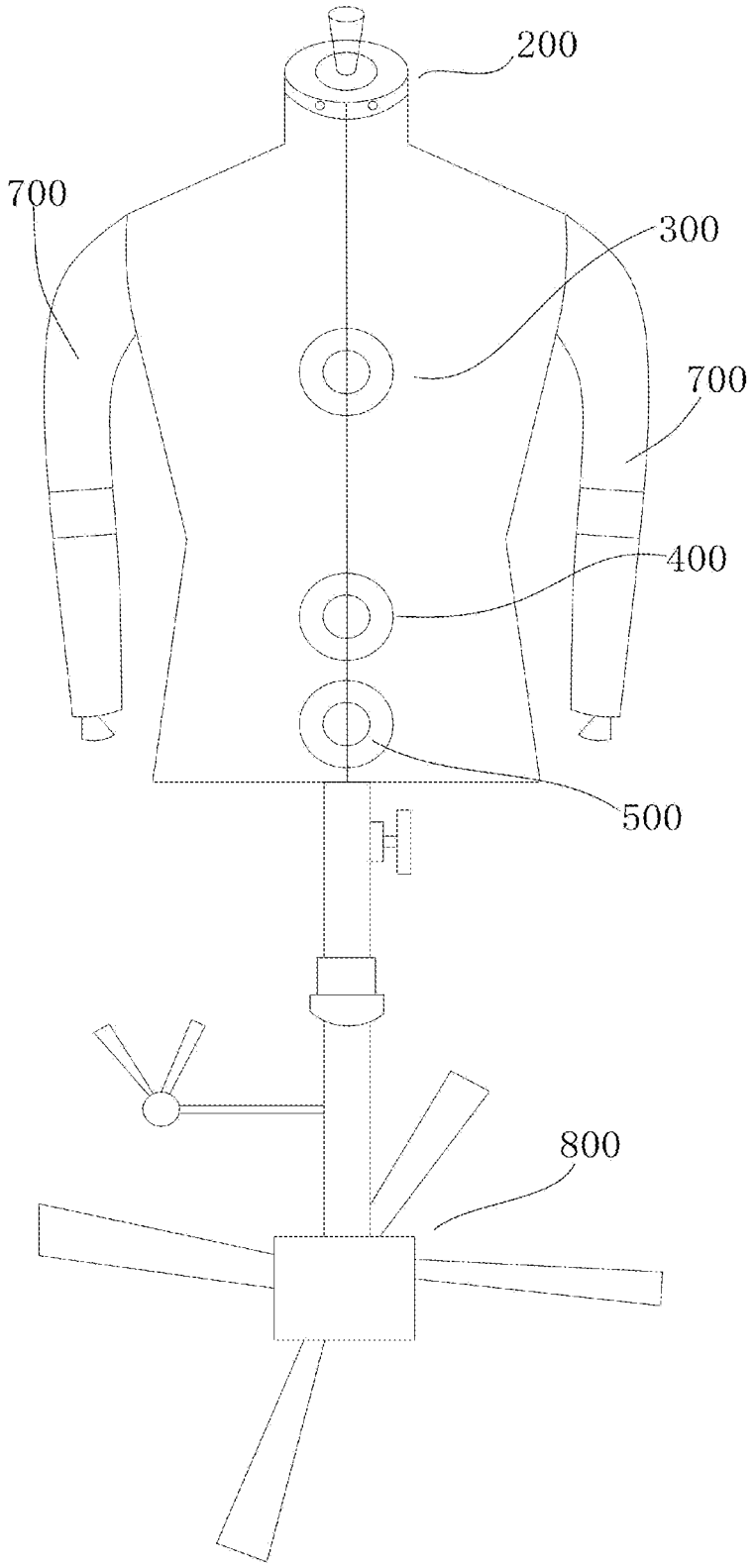
FIG. 13 is a schematic front view of a dressmaker form according to an embodiment of the present application in a completely installed state.

Referring to FIG. 1 and FIG. 13, the chest adjusting system 300, the waist adjusting system 400 and the hip adjusting system 500 are of similar structures, and each include a multi-axis synchronous co-directional adjusting device 600 and an adjusting knob 645. The multi-axis synchronous co-directional adjusting device 600 according to an embodiment of the present application is a four-axis synchronous co-directional adjusting device. In other embodiments, it may also be a five-axis synchronous co-directional adjusting device, a six-axis synchronous co-directional adjusting device and the like.

In one embodiment, the central-support adjusting system 100 includes an upper-body support assembly 110 and a lower-body support assembly 120, where the upper-body support assembly 110 is provided with mounting positions adapted to the four-axis synchronous co-directional adjusting devices. That is, the upper-body support assembly 110 forms a mounting support element for the chest adjusting system 300, the waist adjusting system 400 and the hip adjusting system 500. The neck adjusting system 200 is also mounted on the upper-body support assembly 110.

Figure 2:
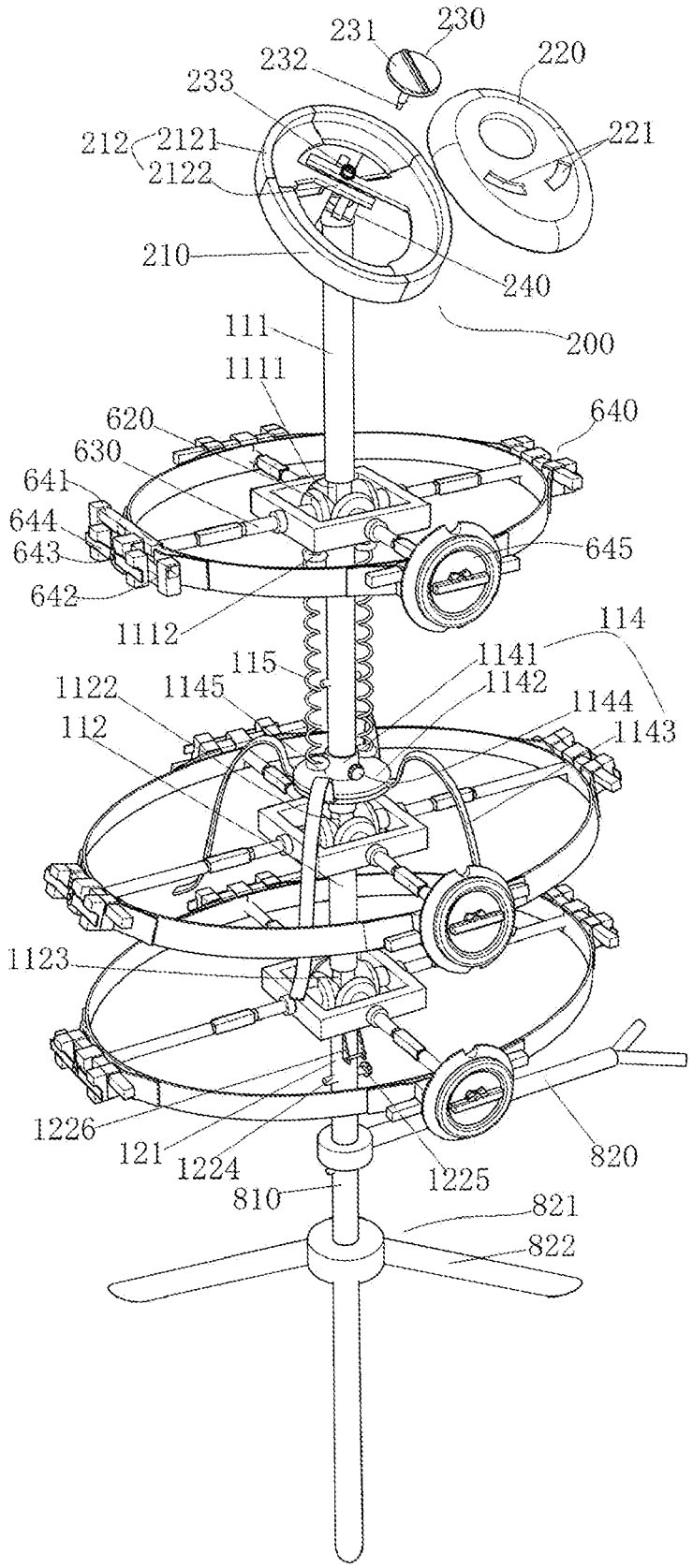
FIG. 2 is a schematic structural view of a dressmaker form according to an embodiment of the present application, taken form a certain perspective, where a neck adjusting system is partially disassembled.

Referring to FIG. 2, each of the four-axis synchronous co-directional adjusting devices includes a fixed frame 610 and four adjusting components each mounted on the fixed frame 610, where each of the four adjusting components includes a bevel gear 620, a telescopic structural member 640 and a transmission rod 630 connecting the bevel gear 620 with the telescopic structural member 640. The multiple bevel gears 620 are arranged to circle an outer wall of the upper-body support assembly 110 in the fixed frame 610, and any two adjacent bevel gears 620 are engaged with each other for transmission. The fixed frame 610 is in a form of a square, and each transmission rod 630 is directed through a side wall of the fixed frame 610 to connect with the corresponding telescopic structural member 640. Each transmission rod 630 is rotatable relative to the fixed frame 610, and partial structure of the transmission rod 630 may be in a form of a square rod.

Referring to FIG. 2, each telescopic structural member 640 includes a first adjusting rod 641, a second adjusting rod 642 and an adjusting shaft 643 connected with the corresponding transmission rod 630, where the first adjusting rod 641 and the second adjusting rod 642 are arranged to oppose each other and be spaced apart in an up-down direction, and the adjusting shaft 643 is arranged between the first adjusting rod 641 and the second adjusting rod 642 and is engaged with the first adjusting rod 641 and the second adjusting rod 642 respectively for transmission.

In one embodiment, the upper-body outer housing is formed by four housing units connected end to end in sequence, and one of any two adjacent housing units is connected with the first adjusting rod 641 and the other is connected with the second adjusting rod 642.

The adjusting knob 645 is connected with any one of the adjusting shafts 643, where when the adjusting knob 645 is rotated in a first rotation direction, the corresponding adjusting shaft 643 is driven to rotate forward, driving the first adjusting rod 641 to move in a first horizontal direction and driving the second adjusting rod 642 to move in a second horizontal direction, where the first horizontal direction is opposite to the second horizontal direction, so that a distance between the two housing units connected with the first adjusting rod 641 and the second adjusting rod 642 respectively is gradually increased; and when the adjusting knob 645 is rotated in a second rotation direction, the adjusting shaft 643 is driven to rotate reversely, driving the first adjusting rod 641 to move in the second horizontal direction and driving the second adjusting rod 642 to move in the first horizontal direction, so that the distance between two housing units connected with the first adjusting rod 641 and the second adjusting rod 642 respectively is gradually reduced.

In one embodiment, each four-axis synchronous co-directional adjusting device includes four adjusting components. The telescopic structural member 640 further includes a scale 644, and the first adjusting rod 641 and the second adjusting rod 642 are each provided with a sliding groove adapted to an end of the scale 644. When the first adjusting rod 641 and the second adjusting rod 642 are driven to move, the scale 644 is configured for measuring the distance between two housing units connected with the first adjusting rod 641 and the second adjusting rod 642 respectively.

In FIG. 2, in order to illustrate the structure and mounting position of the four-axis synchronous co-directional adjusting device, the upper-body outer housing is not shown in the drawing. In order to show the mounting position of the telescopic structural member 640, a partial housing circle is shown at the chest, the waist and the hip respectively, and the telescopic structural member 640 is mounted outside the housing circle to show the structure of the telescopic structural member 640. However, in a practical application, the telescopic structural member 640 should be mounted inside the housing of the dressmaker form, so that the outer housing of the dressmaker form can be flat, and an outer surface of the dressmaker form fits the human body better when tailoring.

It can be seen from the above that the chest adjusting system 300, the waist adjusting system 400 and the hip adjusting system 500 of the dressmaker form provided by the present application are each adjusted by the multi-axis synchronous co-directional adjusting device 600. In specific applications, the multi-axis synchronous co-directional adjusting device 600 may be a four-axis synchronous co-directional adjusting device which divides the upper-body outer housing into four parts. A distance between two connected parts is adjusted by the four-axis synchronous co-directional adjusting device. In the process of adjustment, it is simple and easy to realize synchronous adjustment by the adjusting knob 645.

The structure of the upper-body support assembly 110 is described in detail below.

In one embodiment, the upper-body support assembly 110 includes a first pipe body 111 and a second pipe body 112, where the second pipe body 112, with one end inserted into the first pipe body 111, reciprocatingly telescopes along a central axis of the first pipe body 111.

Figure 3:
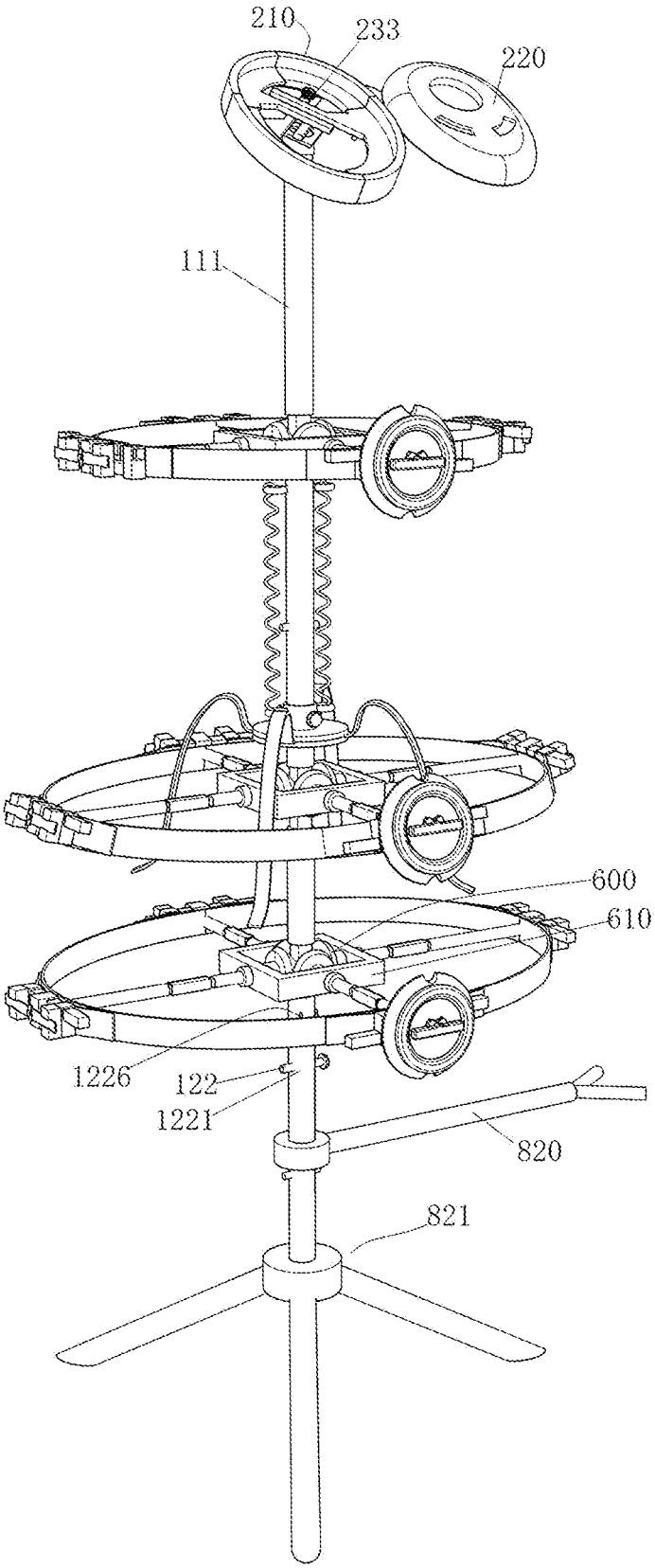
FIG. 3 is a schematic structural view of a dressmaker form according to an embodiment of the present application, taken form a certain perspective.

In one embodiment, a first annular recess 1111 is formed on the first pipe body 111, and the first annular recess 1111 is a clamping recess depressed from a side wall of the first pipe body 111 to a center of the pipe body. Referring to FIG. 3, multiple bevel gears 620 of the four-axis synchronous co-directional adjusting device of the chest adjusting system 300 are arranged to circle an outer wall of the first annular recess 1111.

In one embodiment, the first pipe body 111, along its radial direction, is inserted with a spring fixing pin 1112 arranged below the first annular recess 1111.

In one embodiment, one end of the second pipe body 112 is adapted to an inner diameter of the first pipe body 111, and the other end of the second pipe body forms a lock flange 1121. A second annular recess 1122 and a third annular recess 1123, with the same structure as the first annular recess 1111, are spaced apart on the second pipe body 112, where multiple bevel gears 620 of the four-axis synchronous co-directional adjustment device of the waist adjusting system 400 are arranged to circle an outer wall of the second annular recess 1122, and multiple bevel gears 620 of the four-axis synchronous co-directional adjusting device of the hip adjusting system 500 are arranged to circle an outer wall of the third annular recess 1123.

Figure 6:
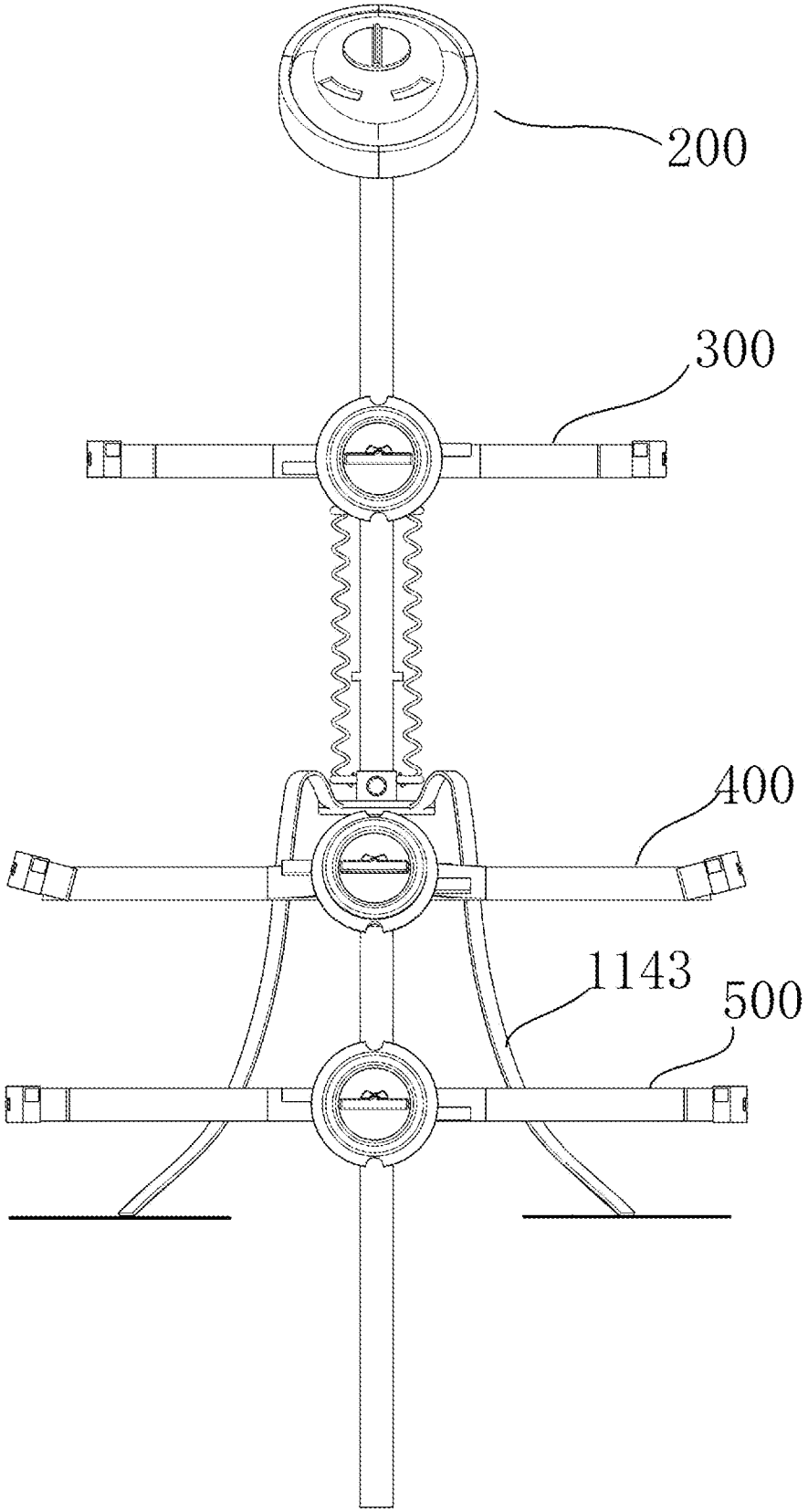
FIG. 6 is a schematic structural view of a partial structure of a dressmaker form according to an embodiment of the present application, taken form a certain perspective, and schematically showing a structural state that an S-shaped fixing iron sheet is fixed to the bottom of an upper-body outer housing.
Figure 7:
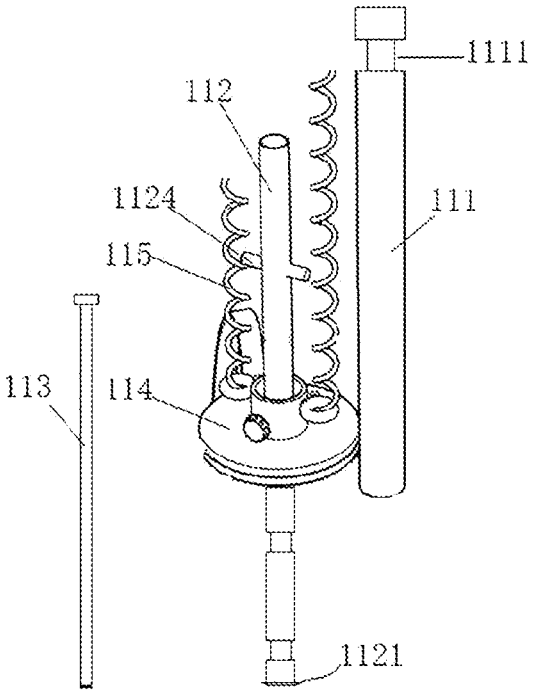
FIG. 7 is a schematic exploded view of a first pipe body and a second pipe body of a dressmaker form according to an embodiment of the present application.

In one embodiment, referring to FIG. 3, a fixing component 114 is sleeved outside an outer wall of the first pipe body 111 at which the first pipe body is connected with the second pipe body 112. The fixing component 114 includes a fixing ring 1141 and a fixing disk 1142 arranged at one end of the fixing ring 1141, where multiple fixing iron sheets 1143 are evenly distributed along an edge of the fixing disk 1142. One end of each fixing iron sheet 1143 is connected with the fixing disk 1142, and the other end thereof extends toward the base and is fixedly connected with the bottom of the upper-body outer housing. The fixing iron sheet 1143 is S-shaped, which can be seen in FIG. 6. The fixing iron sheet shown in FIG. 6 extends downward to below the hip adjusting system until it is connected with the upper-body outer housing, thus forming a flexible support for the upper-body outer housing.

In one embodiment, the fixing ring 1141 is sleeved outside the outer wall of the first pipe body 111, and the inner diameter of the fixing ring 1141 is greater than the outer diameter of the first pipe body 111. The outer wall of the fixing ring 1141 is provided with a fastening screw 1144, one end of the fastening screw 1144 is directed through the outer wall of the fixing ring 1141 to abut against the outer wall of the first pipe body 111, and the fastening screw 1144 is threaded to the fixing ring 1141.

In one embodiment, the side wall of the fixing ring 1141 is provided with a spring mounting seat 1145 corresponding to the spring fixing pin 1112, and the spring mounting seat 1145 and the spring fixing pin 1112 form mounting positions for two ends of a telescopic spring 115 respectively. The number of the telescopic spring 115 is more than one.

In one embodiment, a pipe section, inserted into the first pipe body 111, of the second pipe body 112 is provided with a first positioning pin 1124 which is arranged in the second pipe body 112 along the radial direction of the second pipe body 112.

In one embodiment, the second pipe body 112 is internally provided with an ejecting rod 113, where one end of the ejecting rod 113 is provided with a cross groove, and the first positioning pin 1124 is embedded in the cross groove for positioning the ejecting rod 113. When the ejecting rod 113 moves up and down, the cross groove may limit the ejecting rod 113 and prevent the ejecting rod 113 from dislocation.

It can be seen that the upper-body support assembly 110 of the body-size-adjustable dressmaker form provided according to the present application includes a first pipe body 111, a second pipe body 112 inserted in the first pipe body 111, and a fixing component 114 sleeved outside an outer wall of the first pipe body 111 at which the first pipe body is connected with the second pipe body 112. A telescopic spring 115 is mounted to the fixing component 114 and the first pipe body 111, and the second pipe body 112 is provided with an ejecting rod 113 configured to be driven to move up and down to realize telescopic adjustment of the central waist length.

The structure of the lower-body support assembly 120 is described in detail below.

Figure 4:
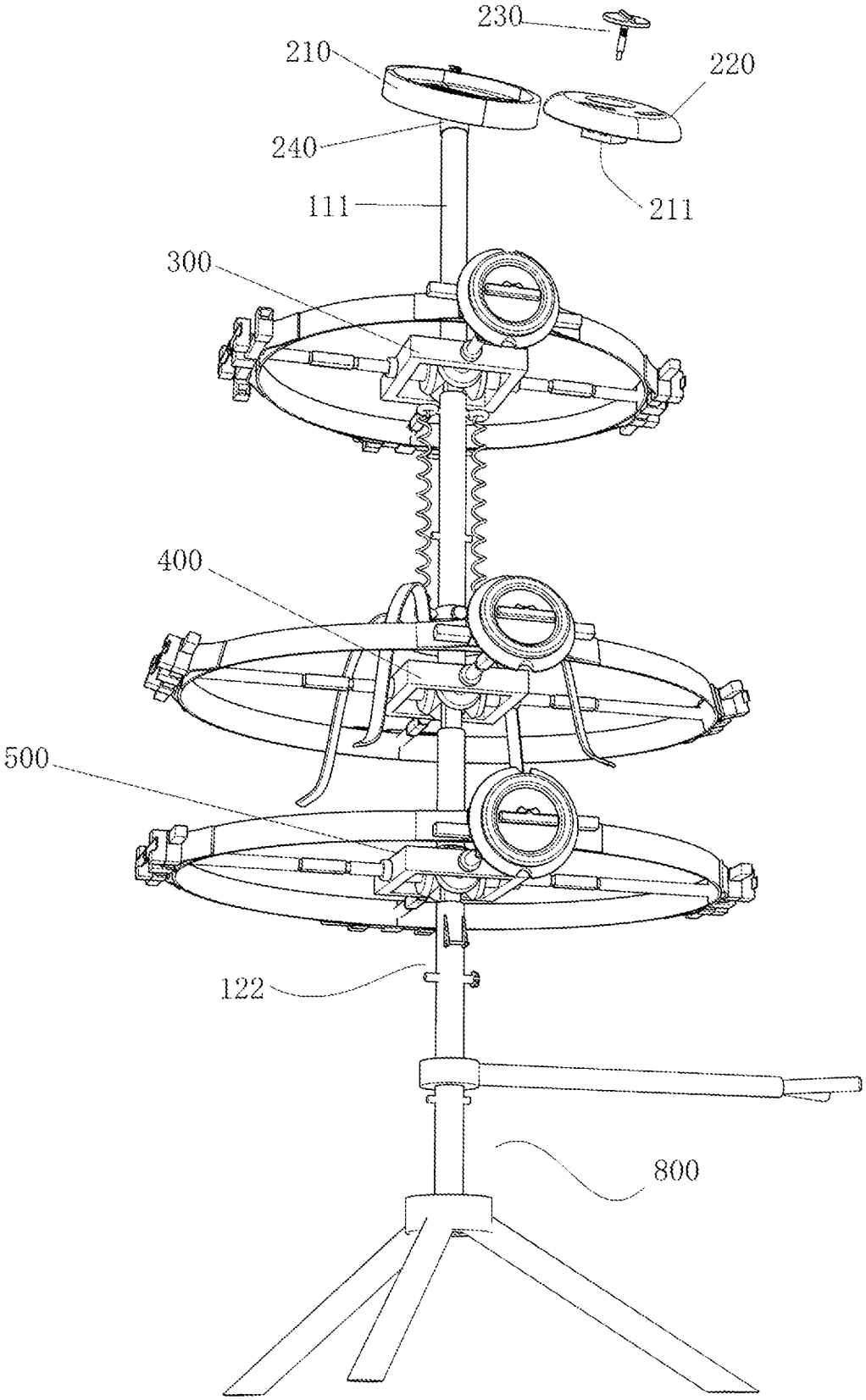
FIG. 4 is a schematic structural view of a dressmaker form according to an embodiment of the present application, taken form a certain perspective, where a neck adjusting system is partially disassembled.
Figure 5:
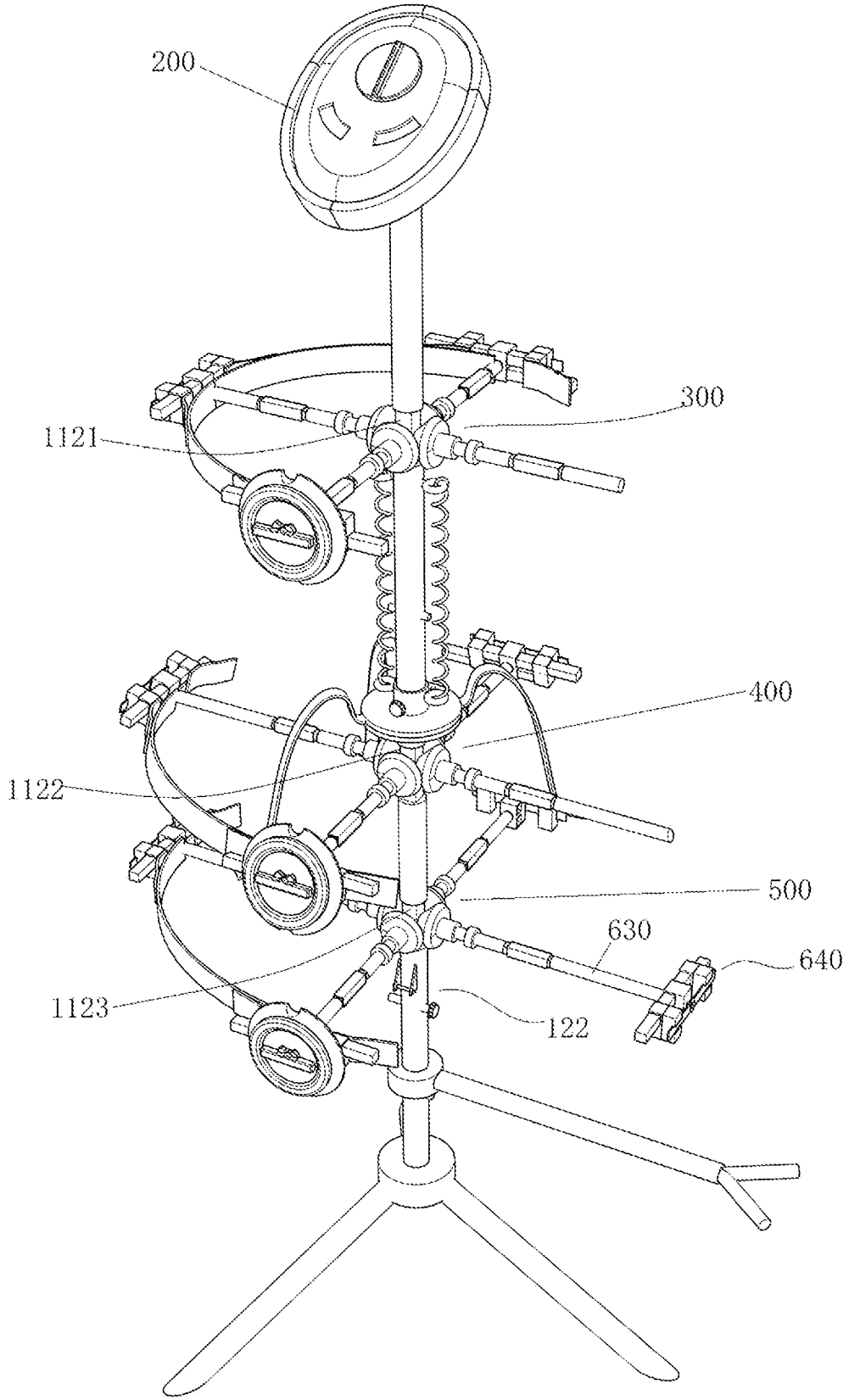
FIG. 5 is a schematic structural view of a partial structure of a dressmaker form according to an embodiment of the present application, taken form a certain perspective.
Figure 8:
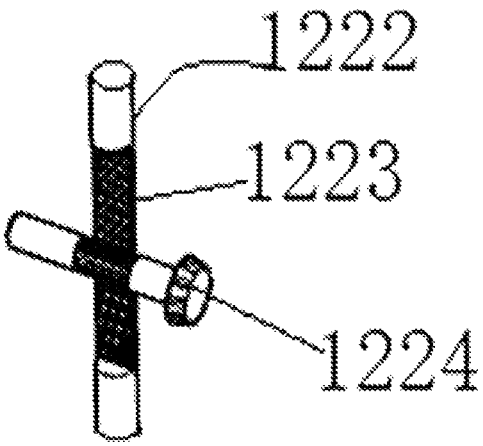
FIG. 8 is a schematic structural view of a telescopic adjusting component according to an embodiment of the present application, taken from a certain perspective.

In one embodiment, referring to FIGS. 4, 5 and 8, the lower-body support assembly 120 includes a third pipe body 121 and a telescopic adjusting component 122 arranged on the third pipe body 121. The telescopic adjusting component 122 includes a cylindrical housing 1221, a push-pull rod 1222, an adjusting screw 1224 and a fixing clip 1226.

In one embodiment, the cylindrical housing 1221 is a cylinder with an opening at one end. The push-pull rod 1222 is inserted into the cylindrical housing 1221 from the opening, and the other end of the cylindrical housing 1221 is provided with a connecting screw.

In one embodiment, a side wall of the push-pull rod 1222 is formed with a slot in which a transmission rack 1223 is arranged. The transmission rack 1223 extends along a central axis direction of the push-pull rod 1222, and a size indicator is arranged on the side wall, close to the base 800, of the push-pull rod 1222.

In one embodiment, two through holes are oppositely arranged on the side wall of the cylindrical housing 1221, and the adjusting screw 1224 is directed through the two through holes in turn. The adjusting screw 1224, through its teeth adapted to the transmission rack 1223, is engaged with the push-pull rod 1222 for transmission, and the push-pull rod 1222 is driven by the adjusting screw 1224 to extend up and down along the central axis of the cylindrical housing 1221.

In one embodiment, one end of the adjusting screw 1224 is provided with a clamping member, and an outer diameter of the clamping member is greater than the width of a guide groove 7232, so as to limit the adjusting screw 1224. The other end of the adjusting screw 1224 is provided with a nut, and a limit spring 1225 is arranged between the nut and the side wall of the cylindrical housing 1221 to abut against the nut and the side wall of the cylindrical housing 1221 respectively.

In one embodiment, the fixing clip 1226, close to the opening, is arranged on the side wall of the cylindrical housing, and an end of the push-pull rod 1222 protruding from the opening is connected with an end of the ejecting rod 113. The end of the cylindrical housing with the opening is connected with the lock flange 1121. The fixing clip 1226 is configured to lock and release the lock flange 1121.

It can be seen that the lower-body support assembly 120 of the body-size-adjustable dressmaker form provided according to the present application includes a third pipe body 121 and a telescopic adjusting component 122 arranged on the third pipe body 121. The telescopic adjusting component 122 can abut against the ejecting rod 113, and the upward and downward movement of the ejecting rod 113 is realized through the push-pull rod 1222 of the telescopic adjusting component 122, so as to drive the adjustment of the central waist length. In one embodiment, the telescopic adjusting component 122 is provided with a size indicator configured to indicate the adjusted length intuitively, and the operator can directly obtain the adjusted central waist length from the size indicator.

The structure of the neck adjusting system 200 is described in detail below.

In one embodiment, the neck adjusting system 200 includes a collar telescopic adjusting component 210, an embedded cover component 220, an adjusting handle 230 and a connecting elbow 240.

In one embodiment, referring to FIG. 4, the collar telescopic adjusting component 210 includes a built-in fixing member 211 and an even number of telescopic members 212 mounted on the built-in fixing member 211. The even number of telescopic members 212 are connected in sequence to form an annular collar structure, and each of the telescopic members 212 includes an arc-shaped housing 2121 and a rack shaft 2122 arranged on a concave surface of the arc-shaped housing 2121. When the even number of telescopic members 212 are connected into the annular structure, the even number of rack shafts 2122 are inserted into reserved channels of the built-in fixing member 211 respectively, so that the even number of rack shafts 2122 are staggered to form an annular channel. A center point of the annular channel coincides with a center point of the annular structure, and the annular channel forms a mounting position for the adjusting handle 230. The annular channel is in a form of a closed pattern with any number of sides, such as quadrangle, pentagon, hexagon and the like. When it is a polygon with many sides, it is similar to a circle.

In one embodiment, the collar telescopic adjusting component 210 includes four telescopic members 212 mounted on the built-in fixing member 211, and the four telescopic members 212 are connected in sequence to form the annular collar structure. The rack shafts 2122 on the four telescopic members 212 are staggered to form a closed quadrilateral channel, and the four rack shafts 2122 may be arranged in two layers up and down, thus avoiding the problem of transmission interference.

In one embodiment, the embedded cover component 220 includes a disk embedded in the annular structure defined by the even number of telescopic members 212, and an outer diameter of the disk is smaller than an inner diameter of the annular structure. A through hole is defined at the center of the disk, and a surface, facing away from the telescopic member 212, of the disk is provided with size scale marks and multiple grooves, where the size scale marks are arranged along the through hole, and pin foam 221 is arranged in the multiple grooves.

In one embodiment, the adjusting handle 230 is a T-shaped member. The adjusting handle 230 includes a transmission shaft and a driving knob 231 arranged at one end of the transmission shaft, and an insertion hole 232 is defined at the other end of the transmission shaft. The side wall, between the driving knob 231 and the insertion hole 232, of the transmission shaft is formed with teeth adapted to the rack shaft 2122, and a stop spring 233 is sleeved outside the outer wall of the transmission shaft.

In one embodiment, the transmission shaft sleeved with the stop spring 233 is directed through the through hole on the disk and the annular channel on the collar telescopic adjusting component 210 in sequence. The insertion hole 232 on the transmission shaft is located outside the annular channel, and a pin is mounted in the insertion hole 232, so that the adjusting handle 230 is detachably connected to the collar telescopic adjusting component 210.

In one embodiment, an upper surface of the driving knob 231 is higher than an upper surface of the disk. When the adjusting handle 230 is pressed down and the driving knob 231 is rotated, the teeth on the adjusting handle 230 drive the rack shafts 2122 of the telescopic members 212 to move back and forth along the reserved channels of the built-in fixing member 211, realizing the telescopic adjustment for the even number of telescopic members 212. Thus, the circumference of the annular structure defined by the arc-shaped housing 2121 of the even number of telescopic members 212 can be expanded or reduced. The upper surface of the driving knob 231 is higher than the upper surface of the disk, which is more convenient for the operator to grasp the driving knob 231 and is convenient for use.

In one embodiment, the connecting elbow 240 includes an elbow-pipe structural member. One end of the connecting elbow 240 forms an inclined mounting seat, where an inclination angle of the inclined mounting seat is the same as that of the neck relative to the spine of a human body, the inclined mounting seat is connected with the bottom of the built-in fixing member 211, and the other end of the connecting elbow 240 is connected with the central-support adjusting system 100.

In one embodiment, a side wall of the connecting elbow 240 is provided with a locking hole in which a fastening pin adapted thereto is inserted.

It can be seen that the neck adjusting system 200 of the body-size-adjustable dressmaker form according to the present application includes a collar telescopic adjusting component 210, an embedded cover component 220, an adjusting handle 230 and a connecting elbow 240. The neck adjusting system is connected with the upper-body support assembly 110 through the connecting elbow 240. The collar telescopic adjusting component 210 realizes telescopic adjustment of the outer diameter of the collar through the built-in fixing member 211 and the even number of telescopic members 212 mounted on the built-in fixing member 211, and the driving knob 231 can realize synchronous adjustment of the even number of telescopic members 212. The disk of the embedded cover component 220 is provided with a groove for accommodating pin foam 221 configured for accommodating pins for fixing cloth.

The structure of the arm adjusting system 700 is described in detail below.

In one embodiment, the arm adjusting system 700 according to the present application includes an arm outer housing and an arm size-adjusting mechanism arranged inside the arm outer housing.

In one embodiment, the arm outer housing is formed by a first housing and a second housing, where the first housing includes a first upper arm housing and a first forearm housing, and the second housing includes a second upper arm housing and a second forearm housing. The first housing and the second housing are joined in a front-rear or left-right direction, and magnets are arranged at one end of the first housing and one end of the second housing respectively, allowing the first housing and the second housing to be attached to shoulder parts of the upper-body outer housing through the magnets. Dividing the arm outer housing into housing units is more conducive to the adjustment of arm circumference and arm length.

In one embodiment, the arm size-adjusting mechanism includes an arm-circumference adjusting component 710 and an arm-length adjusting component 720.

Figure 9:
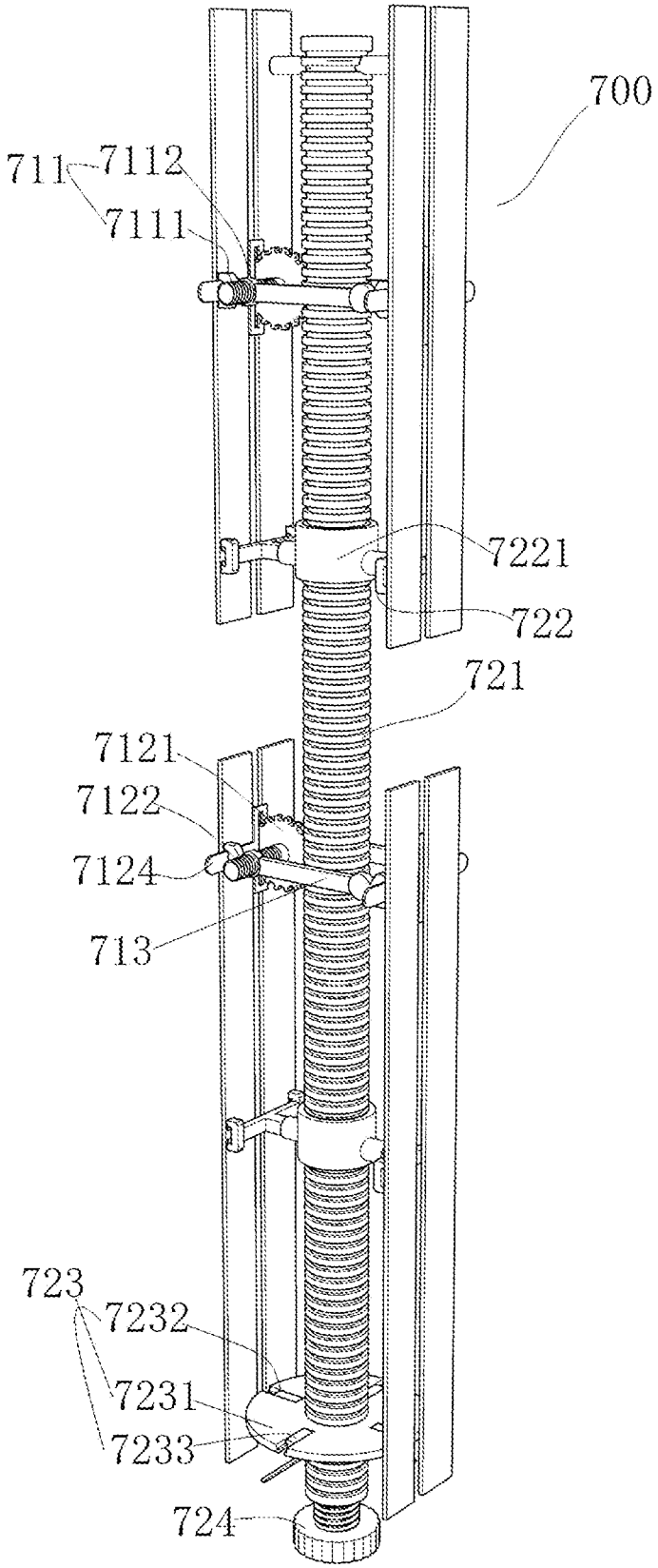
FIG. 9 is a schematic structural view of an arm adjusting system according to an embodiment of the present application, taken from a certain perspective.
Figure 10:
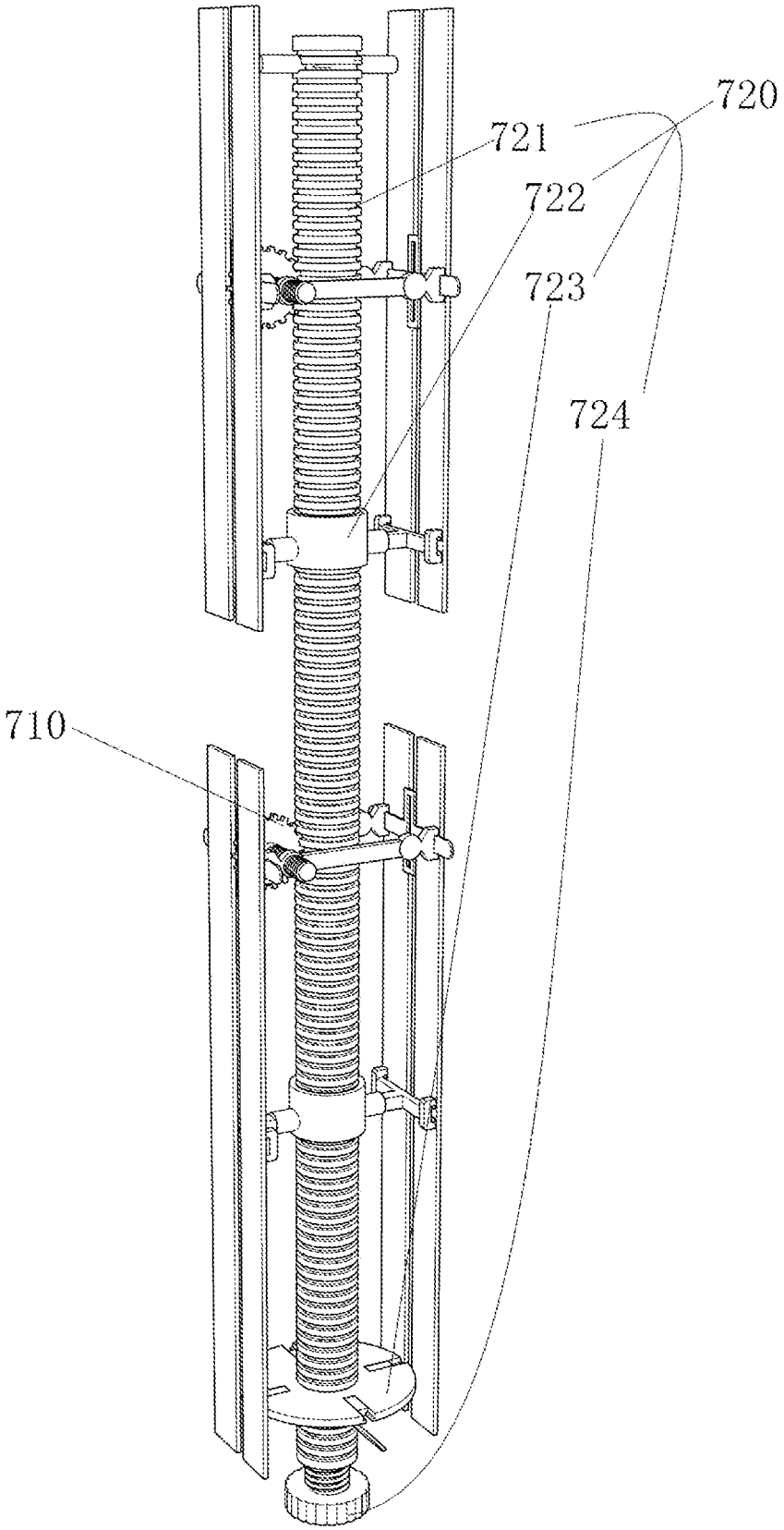
FIG. 10 is a schematic structural view of an arm adjusting system according to an embodiment of the present application, taken from another perspective.

In one embodiment, referring to FIGS. 9 and 10, one arm-circumference adjusting component 710 is arranged at a joint of the first upper arm housing and the second upper arm housing, and the arm-circumference adjusting component 710 is connected with both the first upper arm housing and the second upper arm housing. Another arm-circumference adjusting component 710 is arranged at a joint of the first forearm housing and the second forearm housing, and the arm-circumference adjusting component 710 is connected with both the first forearm housing and the second forearm housing.

Figure 11:
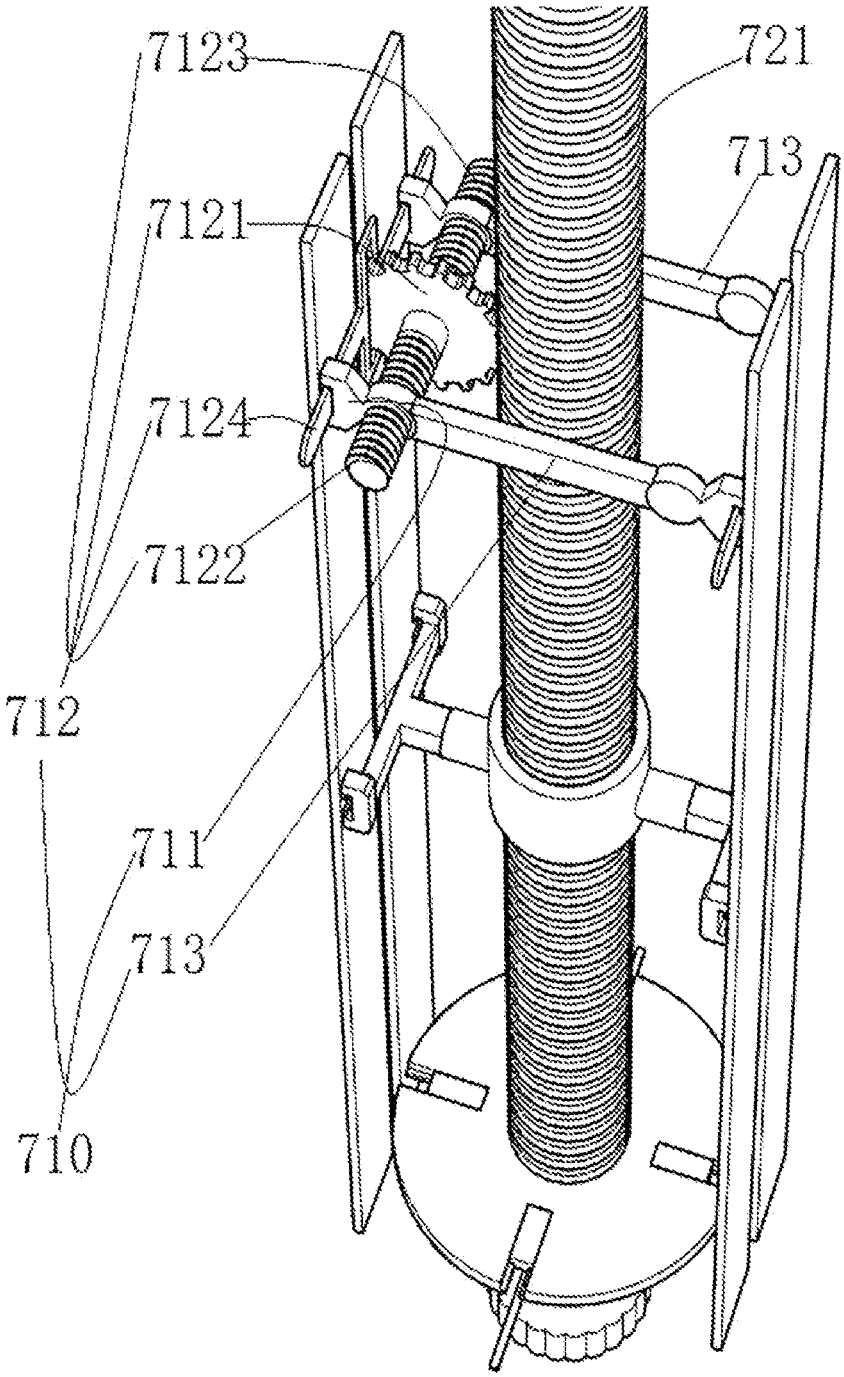
FIG. 11 is a schematic structural view of a partial structure of an arm adjusting system according to an embodiment of the present application.
Figure 12:
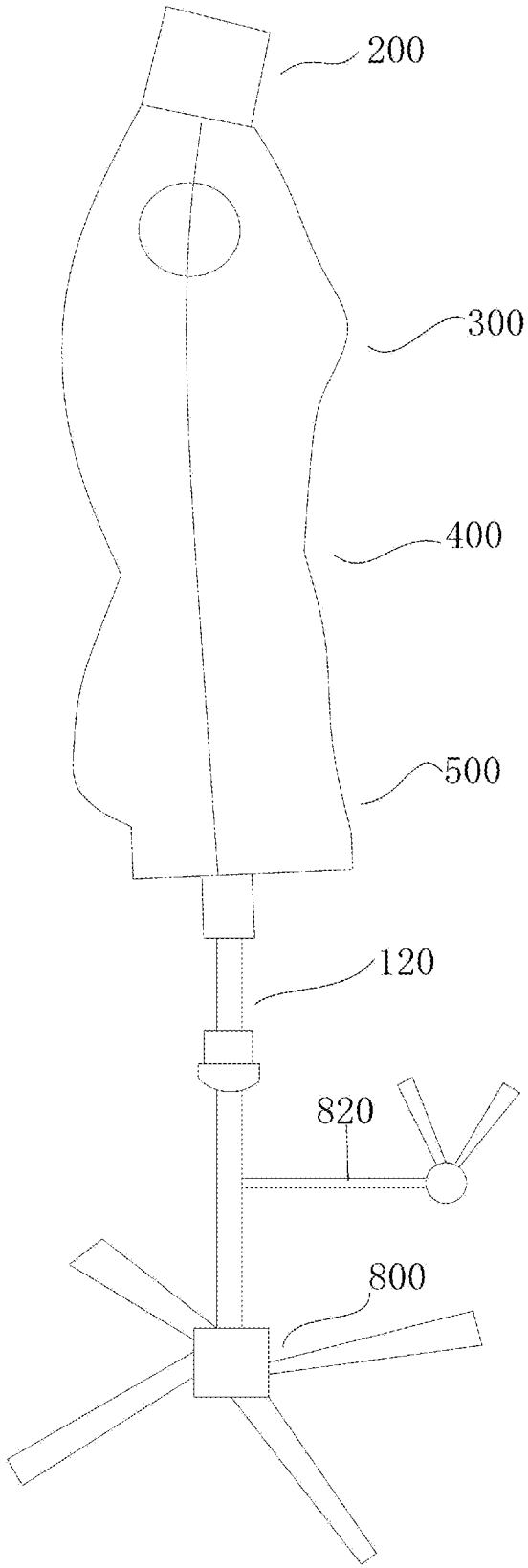
FIG. 12 is a schematic side view of a torso part of a dressmaker form according to an embodiment of the present application in an installed state, where the illustrated dressmaker form is not equipped with an arm part.

In one embodiment, referring to FIG. 11, the arm-circumference adjusting component 710 includes two housing fixing members 711 arranged opposite to each other, a telescopic adjusting member 712 connected with the two housing fixing members 711, and a fixed scale 7124 arranged on the two housing fixing members 711. One end of each housing fixing member 711 forms a connecting seat 7111 connected with the arm outer housing, and the other end thereof forms a mounting hole 7112 adapted to the telescopic adjusting member 712. The telescopic adjusting member 712 includes a driving wheel 7121, and a left driving rod 7122 and a right driving rod 7123 arranged on two sides of the driving wheel 7121 respectively, where the left driving rod 7122 is provided with right-handed teeth and the right driving rod 7123 is provided with left-handed teeth, and each of the left driving rod 7122 and the right driving rod 7123 is adaptively connected with the mounting hole 7112 of the corresponding housing fixing member 711. The mounting hole 7112 of one of the two housing fixing members 711 is provided with teeth that engage with the right-handed teeth on the left driving rod 7122, and the mounting hole 7112 of the other housing fixing member 711 is provided with teeth that engage with the left-handed teeth on the right driving rod 7123.

In one embodiment, the arm-circumference adjusting component further includes two linkage rods 713 connected with the housing fixing members 711. An end, facing away from the housing fixing members 711, of each linkage rod 713 is connected with the arm outer housing, and each linkage rod is provided with a slide groove in which a fixed scale is arranged. The two linkage rods 713 are driven by the housing fixing members 711 to move left and right.

In one embodiment, referring to FIG. 9, the arm-length adjusting component 720 includes a telescopic rod 721 arranged inside the arm outer housing along the length direction of the arm outer housing, a fixed mounting component 722, a guide adjusting member 723 and a rotational knob 724.

In one embodiment, an outer wall of the telescopic rod 721 is provided with teeth adapted to the driving wheel 7121. One end of the telescopic rod 721 is located in the upper arm part of the arm outer housing, and a through hole, with a pin shaft inserted therein, is arranged on the side wall near this end. The other end of the telescopic rod is located in the forearm part of the arm outer housing, and this end is provided with the rotational knob 724.

In one embodiment, the fixed mounting component 722 includes a mounting cap 7221 sleeved outside the telescopic rod 721 and engaged with the telescopic rod 721 for transmission. The outer wall of the mounting cap 7221 is provided with a connector connected with the inner wall of the arm outer housing. The connector includes a connecting rod and a fixing cap which is slidably connected with the connecting rod and fixed on the arm outer housing.

In one embodiment, the guide adjusting member 723 is mounted on the side wall of the telescopic rod 721 near the rotational knob 724, and includes a guide plate 7231 sleeved outside the outer wall of the telescopic rod 721. The center of the guide plate 7231 is provided with a connecting hole which is engaged with the telescopic rod 721, and four guide grooves 7232 are formed on the guide plate 7231. Each of the four guide grooves 7232 is such groove extending from an outer edge of the guide plate 7231 toward the outer wall of the connecting hole. The four guide grooves 7232 are provided with four slide members 7233 respectively each of which is connected with the first forearm housing or the second forearm housing.

In one embodiment, when the telescopic rod 721 is driven to rotate by turning the rotational knob 724, the telescopic rod 721 drives the driving wheel 7121 engaged therewith to rotate, so that the two housing fixing members 711 engaged with the left driving rod 7122 and the right driving rod 7123 respectively get close to each other or away from each other. When the two housing fixing members 711 approach each other, outer diameters of the upper arm housing and the forearm housing formed by the first housing and second housing are reduced at the same time. When the two housing fixing members 711 move away from each other, the outer diameters of the upper arm housing and the forearm housing formed by the first housing and second housing are increased at the same time. When the outer diameters of the upper arm housing and the forearm housing formed by the first housing and the second housing are simultaneously reduced or increased, the slide members 7233 are driven to slide in the guide grooves 7232.

In one embodiment, two fixed mounting components 722 are provided, where one of the two fixed mounting components 722 is mounted on the upper arm part of the arm outer housing, and the other is mounted on the forearm part of the arm outer housing. When the telescopic rod 721 is driven to rotate by turning the knob 724, the mounting cap 7221 of each of the two fixed mounting components 722 slides up and down relative to the telescopic rod 721, so that the housing of the upper arm part connected with one of the two fixed mounting components 722 moves close to or away from the housing of the forearm part connected with the other fixed mounting component 722, thus realizing the adjustment of arm length.

It can be seen that the arm-circumference adjusting components 710 and the arm-length adjusting component 720 according to the present application can be adjusted at the same time via a rotational knob 724, the adjustment being simple and convenient. The arm-circumference adjusting component 710 is provided with a fixed scale 7124, and the operator can directly know the arm circumference from the fixed scale 7124.

The structure of the base 800 is described in detail below.

In one embodiment, the base 800 according to the present application includes a fourth pipe body 810 and a bottom support 821 arranged at one end of the fourth pipe body 810, as shown in FIG. 5.

In one embodiment, the fourth pipe body 810 is connected with the third pipe body 121, and a support frame 820 is mounted on a side wall of the fourth pipe body 810. One end of the support frame 820 is rotatably connected with the fourth pipe body 810, and the other end of the support frame is provided with a V-shaped clip. One end of the support frame 820 may be provided with a sleeve, which is sleeved outside the side wall of the fourth pipe body 810, and the support frame 820, by moving it, may rotate relative to the fourth pipe body 810 through the sleeve to realize angle adjustment. The support frame 820 can clamp, measure and position a dress hemline and assist in tailoring.

In one embodiment, the bottom support 821 includes a support seat 822 and rollers arranged at the bottom of the support seat 822. The support seat 822 may be a polygonal or circular plate-shaped member, and multiple rollers are arranged on one side of the plate-shaped member to realize movement. A stop piece may be arranged on the rollers or the support seat, so that the rollers may be locked by the stop piece in the tailoring process, and the dressmaker form can be prevented from deviating.

In one embodiment, the support seat 822 may also be multiple support rods which are radially distributed around the side wall of the fourth pipe body 810 to support the dressmaker form. A roller and a roller stop mechanism may be arranged at an end of each of the support rods.

To sum up, the body-size-adjustable dressmaker form according to the present application includes a central-support adjusting system, a neck adjusting system, a chest adjusting system, a waist adjusting system, a hip adjusting system, an arm adjusting system, a base and an upper-body outer housing, which solves the problem of complicated adjustment steps of various parts of the existing dressmaker form.

The technical features in the foregoing embodiments may be combined at will (provided that they do not conflict with each other). For concise description, not all possible combinations of the technical features in the above embodiments are described. However, these embodiments that are not explicitly described shall fall within the scope of this specification.

The present application has been described in detail through general description and specific embodiments. It should be understood that based on the technical concept of the present application, some conventional adjustments or further innovations can be made to these specific embodiments. However, as long as these conventional adjustments or further innovations do not deviate from the technical concept of the present application, the technical solutions obtained by these conventional adjustments or further innovations also fall within the scope of protection of the claims of the present application.

What is claimed is:

1. A body-size-adjustable dressmaker form, comprising a central-support adjusting system, a neck adjusting system, a chest adjusting system, a waist adjusting system, a hip adjusting system, an arm adjusting system, a base and an upper-body outer housing, wherein the chest adjusting system, the waist adjusting system and the hip adjusting system each comprises a multi-axis synchronous co-directional adjusting device and an adjusting knob;

the central-support adjusting system comprises an upper-body support assembly and a lower-body support assembly, wherein the upper-body support assembly is provided with mounting positions adapted to the multi-axis synchronous co-directional adjusting devices;

each of the multi-axis synchronous co-directional adjusting devices comprises a fixed frame and a plurality of adjusting components each mounted on the fixed frame, wherein each of the plurality of adjusting components comprises a bevel gear, a telescopic structural member and a transmission rod connecting the bevel gear with the telescopic structural member; the bevel gears are arranged to circle an outer wall of the upper-body support assembly in the fixed frame, and any two adjacent bevel gears are engaged with each other for transmission;

the telescopic structural member comprises a first adjusting rod, a second adjusting rod and an adjusting shaft connected with the transmission rod, wherein the first adjusting rod and the second adjusting rod are arranged to oppose each other and be spaced apart in an up-down direction, and the adjusting shaft is arranged between the first adjusting rod and the second adjusting rod and is engaged with the first adjusting rod and the second adjusting rod respectively for transmission;

the upper-body outer housing is formed by a plurality of housing units connected end to end in sequence, and one of any two adjacent housing units is connected with the first adjusting rod and the other is connected with the second adjusting rod;

the adjusting knob is connected with one of the adjusting shafts, wherein when the adjusting knob is rotated in a first rotation direction, the corresponding adjusting shaft is driven to rotate forward, driving the first adjusting rod to move in a first horizontal direction and driving the second adjusting rod to move in a second horizontal direction, wherein the first horizontal direction is opposite to the second horizontal direction, so that a distance between the two housing units connected with the first adjusting rod and the second adjusting rod respectively is gradually increased; and when the adjusting knob is rotated in a second rotation direction, the adjusting shaft is driven to rotate reversely, driving the first adjusting rod to move in the second horizontal direction and driving the second adjusting rod to move in the first horizontal direction, so that the distance between two housing units connected with the first adjusting rod and the second adjusting rod respectively is gradually reduced.

2. The body-size-adjustable dressmaker form according to claim 1, wherein each multi-axis synchronous co-directional adjusting device comprises four adjusting components;

the telescopic structural member further comprises a scale, and the first adjusting rod and the second adjusting rod are each provided with a sliding groove adapted to an end of the scale; and when the first adjusting rod and the second adjusting rod are driven to move, the scale is configured for measuring the distance between two housing units connected with the first adjusting rod and the second adjusting rod respectively.

3. The body-size-adjustable dressmaker form according to claim 1, wherein the upper-body support assembly comprises a first pipe body and a second pipe body, wherein the second pipe body, with one end inserted into the first pipe body, reciprocatingly telescopes along a central axis of the first pipe body;

a first annular recess is formed on the first pipe body, and the first annular recess is a clamping recess depressed from a side wall of the first pipe body to a center of the pipe body; a plurality of bevel gears of the multi-axis synchronous co-directional adjusting device of the chest adjusting system are arranged to circle an outer wall of the first annular recess;

the first pipe body, along its radial direction, is inserted with a spring fixing pin arranged below the first annular recess;

one end of the second pipe body is adapted to an inner diameter of the first pipe body, and the other end of the second pipe body forms a lock flange; a second annular recess and a third annular recess, with the same structure as the first annular recess, are spaced apart on the second pipe body, wherein the plurality of bevel gears of the multi-axis synchronous co-directional adjustment device of the waist adjusting system are arranged to circle an outer wall of the second annular recess, and the plurality of bevel gears of the multi-axis synchronous co-directional adjusting device of the hip adjusting system are arranged to circle an outer wall of the third annular recess.

4. The body-size-adjustable dressmaker form according to claim 3, wherein a fixing component is sleeved outside an outer wall of the first pipe body at which the first pipe body is connected with the second pipe body; the fixing component comprises a fixing ring and a fixing disk arranged at one end of the fixing ring, wherein a plurality of fixing iron sheets are evenly distributed along an edge of the fixing disk; one end of each fixing iron sheet is connected with the fixing disk, and the other end thereof extends toward the base and is fixedly connected with the bottom of the upper-body outer housing; the fixing iron sheet is S-shaped;

the fixing ring is sleeved outside the outer wall of the first pipe body, and the inner diameter of the fixing ring is greater than the outer diameter of the first pipe body; an outer wall of the fixing ring is provided with a fastening screw, one end of the fastening screw is directed through the outer wall of the fixing ring to abut against the outer wall of the first pipe body, and the fastening screw is threaded to the fixing ring;

the side wall of the fixing ring is provided with a spring mounting seat corresponding to the spring fixing pin, and the spring mounting seat and the spring fixing pin form mounting positions for two ends of a telescopic spring respectively; and the number of the telescopic spring is more than one.

5. The body-size-adjustable dressmaker form according to claim 3, wherein a pipe section, inserted into the first pipe body, of the second pipe body is provided with a first positioning pin which is arranged in the second pipe body along a radial direction of the second pipe body, the second pipe body is internally provided with an ejecting rod, wherein one end of the ejecting rod is provided with a cross groove, and the first positioning pin is embedded in the cross groove for positioning the ejecting rod.

6. The body-size-adjustable dressmaker form according to claim 5, wherein the lower-body support assembly comprises a third pipe body and a telescopic adjusting component arranged on the third pipe body; the telescopic adjusting component comprises a cylindrical housing, a push-pull rod, an adjusting screw and a fixing clip;

the cylindrical housing is a cylinder with an opening at one end; the push-pull rod is inserted into the cylindrical housing from the opening, and the other end of the cylindrical housing is provided with a connecting screw;

a side wall of the push-pull rod is formed with a slot in which a transmission rack is arranged; the transmission rack extends along a central axis direction of the push-pull rod, and a size indicator is arranged on the side wall, close to the base, of the push-pull rod;

two through holes are oppositely arranged on the side wall of the cylindrical housing, and the adjusting screw is directed through the two through holes in turn; the adjusting screw, through its teeth adapted to the transmission rack, is engaged with the push-pull rod for transmission, and the push-pull rod is driven by the adjusting screw to extend up and down along the central axis of the cylindrical housing;

one end of the adjusting screw is provided with a clamping member, and an outer diameter of the clamping member is greater than the width of a guide groove, so as to limit the adjusting screw; the other end of the adjusting screw is provided with a nut, and a limit spring is arranged between the nut and the side wall of the cylindrical housing to abut against the nut and the side wall of the cylindrical housing respectively;

the fixing clip which is close to the opening is arranged on the side wall of the cylindrical housing, and an end of the push-pull rod protruding from the opening is connected with an end of the ejecting rod; the end of the cylindrical housing with the opening is connected with the lock flange; and the fixing clip is configured to lock and release the lock flange.

7. The body-size-adjustable dressmaker form according to claim 6, wherein the base comprises a fourth pipe body and a bottom support arranged at one end of the fourth pipe body;

the fourth pipe body is connected with the third pipe body, and a support frame is mounted on a side wall of the fourth pipe body; one end of the support frame is rotatably connected with the fourth pipe body, and the other end of the support frame is provided with a V-shaped clip; and the bottom support comprises a support seat and rollers arranged at the bottom of the support seat.

8. The body-size-adjustable dressmaker form according to claim 1, wherein the neck adjusting system comprises a collar telescopic adjusting component, an embedded cover component, an adjusting handle and a connecting elbow;

the collar telescopic adjusting component comprises a built-in fixing member and an even number of telescopic members mounted on the built-in fixing member; the even number of telescopic members are connected in sequence to form an annular collar structure, and each of the telescopic members comprises an arc-shaped housing and a rack shaft arranged on a concave surface of the arc-shaped housing; when the even number of telescopic members are connected into the annular structure, the even number of rack shafts are inserted into reserved channels of the built-in fixing member respectively, so that the even number of rack shafts are staggered to form an annular channel; a center point of the annular channel coincides with a center point of the annular structure, and the annular channel forms a mounting position for the adjusting handle;

the embedded cover component comprises a disk embedded in the annular structure defined by the even number of telescopic members, and an outer diameter of the disk is smaller than an inner diameter of the annular structure; a through hole is defined at the center of the disk, and a surface, facing away from the telescopic member, of the disk is provided with size scale marks and a plurality of grooves, wherein the size scale marks are arranged along the through hole, and pin foam is arranged in the plurality of grooves;

the adjusting handle is a T-shaped member; the adjusting handle comprises a transmission shaft and a driving knob arranged at one end of the transmission shaft, and an insertion hole is defined at the other end of the transmission shaft; a side wall, between the driving knob and the insertion hole, of the transmission shaft is formed with teeth adapted to the rack shaft, and a stop spring is sleeved outside the outer wall of the transmission shaft;

the transmission shaft sleeved with the stop spring is directed through the through hole on the disk and the annular channel on the collar telescopic adjusting component in sequence; the insertion hole on the transmission shaft is located outside the annular channel, and a pin is mounted in the insertion hole, so that the adjusting handle is detachably connected to the collar telescopic adjusting component;

an upper surface of the driving knob is higher than an upper surface of the disk; and when the adjusting handle is pressed down and the driving knob is rotated, the teeth on the adjusting handle drive the rack shafts of the telescopic members to move back and forth along the reserved channels of the built-in fixing member, realizing the telescopic adjustment for the even number of telescopic members, allowing the circumference of the annular structure defined by the arc-shaped housing of the even number of telescopic members to be expanded or reduced.

9. The body-size-adjustable dressmaker form according to claim 8, wherein the connecting elbow comprises an elbow-pipe structural member; one end of the connecting elbow forms an inclined mounting seat, wherein an inclination angle of the inclined mounting seat is the same as that of the neck relative to the spine of a human body, the inclined mounting seat is connected with the bottom of the built-in fixing member, and the other end of the connecting elbow is connected with the central-support adjusting system; and a side wall of the connecting elbow is provided with a locking hole in which a fastening pin adapted thereto is inserted.

10. The body-size-adjustable dressmaker form according to claim 1, wherein the arm adjusting system comprises an arm outer housing and an arm size-adjusting mechanism;

the arm outer housing is formed by a first housing and a second housing, wherein the first housing comprises a first upper arm housing and a first forearm housing, and the second housing comprises a second upper arm housing and a second forearm housing; the first housing and the second housing are joined in a front-rear or left-right direction, and magnets are arranged at one end of the first housing and one end of the second housing respectively, allowing the first housing and the second housing to be attached to shoulder parts of the upper-body outer housing through the magnets;

the arm size-adjusting mechanism comprises an arm-circumference adjusting component and an arm-length adjusting component;

one arm-circumference adjusting component is arranged at a joint of the first upper arm housing and the second upper arm housing, and the arm-circumference adjusting component is connected with both the first upper arm housing and the second upper arm housing; another arm-circumference adjusting component is arranged at a joint of the first forearm housing and the second forearm housing, and the arm-circumference adjusting component is connected with both the first forearm housing and the second forearm housing;

the arm-circumference adjusting component comprises two housing fixing members arranged opposite to each other, a telescopic adjusting member connected with the two housing fixing members, and a fixed scale arranged on the two housing fixing members; one end of each housing fixing member forms a connecting seat connected with the arm outer housing, and the other end thereof forms a mounting hole adapted to the telescopic adjusting member; the telescopic adjusting member comprises a driving wheel, and a left driving rod and a right driving rod arranged on two sides of the driving wheel respectively, wherein the left driving rod is provided with right-handed teeth and the right driving rod is provided with left-handed teeth, and each of the left driving rod and the right driving rod is adaptively connected with the mounting hole of the corresponding housing fixing member; the mounting hole of one of the two housing fixing members is provided with teeth that engage with the right-handed teeth on the left driving rod, and the mounting hole of the other housing fixing member is provided with teeth that engage with the left-handed teeth on the right driving rod;

the arm-circumference adjusting component further comprises two linkage rods connected with the housing fixing members; an end, facing away from the housing fixing members, of each linkage rod is connected with the arm outer housing, and each linkage rod is provided with a slide groove in which a fixed scale is arranged; the two linkage rods are driven by the housing fixing members to move left and right;

the arm-length adjusting component comprises a telescopic rod arranged inside the arm outer housing along the length direction of the arm outer housing, a fixed mounting component, a guide adjusting member and a rotational knob;

an outer wall of the telescopic rod is provided with teeth adapted to the driving wheel; one end of the telescopic rod is located in the upper arm part of the arm outer housing, and a through hole, with a pin shaft inserted therein, is arranged on the side wall near this end; the other end of the telescopic rod is located in the forearm part of the arm outer housing, and this end is provided with the rotational knob;

the fixed mounting component comprises a mounting cap sleeved outside the telescopic rod and engaged with the telescopic rod for transmission; an outer wall of the mounting cap is provided with a connector connected with an inner wall of the arm outer housing; the connector comprises a connecting rod and a fixing cap which is slidably connected with the connecting rod and fixed on the arm outer housing;

the guide adjusting member is mounted on the side wall of the telescopic rod near the rotational knob, and comprises a guide plate sleeved outside the outer wall of the telescopic rod; the center of the guide plate is provided with a connecting hole which is engaged with the telescopic rod, and four guide grooves are formed on the guide plate; each of the four guide grooves is such groove extending from an outer edge of the guide plate toward an outer wall of the connecting hole; the four guide grooves are provided with four slide members respectively each of which is connected with the first forearm housing or the second forearm housing;

when the telescopic rod is driven to rotate by turning the rotational knob, the telescopic rod drives the driving wheel engaged therewith to rotate, so that the two housing fixing members engaged with the left driving rod and the right driving rod respectively get close to each other or away from each other; when the two housing fixing members approach each other, outer diameters of the upper arm housing and the forearm housing formed by the first housing and second housing are reduced at the same time; when the two housing fixing members move away from each other, the outer diameters of the upper arm housing and the forearm housing formed by the first housing and second housing are increased at the same time; when the outer diameters of the upper arm housing and the forearm housing formed by the first housing and the second housing are simultaneously reduced or increased, the slide members are driven to slide in the guide grooves;

two fixed mounting components are provided, wherein one of the two fixed mounting components is mounted on an upper arm part of the arm outer housing, and the other is mounted on a forearm part of the arm outer housing; when the telescopic rod is driven to rotate by turning the knob, the mounting cap of each of the two fixed mounting components slides up and down relative to the telescopic rod, so that the housing of the upper arm part connected with one of the two fixed mounting components moves close to or away from the housing of the forearm part connected with the other fixed mounting component, thus realizing the adjustment of arm length.

* * * * *